US008152004B2

(12) United States Patent
Smith et al.

(10) Patent No.: US 8,152,004 B2
(45) Date of Patent: Apr. 10, 2012

(54) DISPENSER FOR DISPOSABLE CUTLERY AND COMPONENTS THEREFOR

(75) Inventors: Patrick J. Smith, Iola, WI (US); Andy L. Kirkpatrick, Green Bay, WI (US); Michael R. Kilgore, Little Suamico, WI (US); David G. Honan, Concord, MA (US); Thomas J. Sorensen, Green Bay, WI (US); Vito Lore, Providence, RI (US); Timothy D. Jadin, Green Bay, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 1121 days.

(21) Appl. No.: 11/415,836

(22) Filed: May 2, 2006

(65) Prior Publication Data

US 2007/0108141 A1 May 17, 2007

Related U.S. Application Data

(60) Provisional application No. 60/678,365, filed on May 5, 2005, provisional application No. 60/736,622, filed on Nov. 15, 2005.

(51) Int. Cl.
*A47F 7/00* (2006.01)

(52) U.S. Cl. ..... 211/70.7

(58) Field of Classification Search ..... 211/70.7; D7/401.2, 645, 653, 661; 206/553, 541; 30/322, 323, 122, 324

See application file for complete search history.

(56) References Cited

U.S. PATENT DOCUMENTS

| | | | |
|---|---|---|---|
| 592,105 | A | 10/1897 | Barnes |
| 925,485 | A | 6/1909 | Lafler |
| 999,837 | A | 8/1911 | Morris et al. |
| 1,146,447 | A | 7/1915 | Prommel |
| 1,259,927 | A | 3/1918 | Swift |
| 1,355,583 | A | 10/1920 | Zeidler et al. |
| 1,482,071 | A | 1/1924 | Duff et al. |
| 1,504,098 | A | 8/1924 | Cathey |
| 1,546,077 | A | 7/1925 | Hunter et al. |
| 1,547,151 | A | 7/1925 | Watling |
| 1,577,302 | A | 3/1926 | Schultz |
| 1,610,001 | A | 12/1926 | Foster |
| 1,675,510 | A | 7/1928 | Nolan |
| 1,886,378 | A | 11/1932 | Dearsley |
| 2,053,828 | A | 9/1936 | Harper |

(Continued)

FOREIGN PATENT DOCUMENTS

CA 2545745 A1 11/2006

(Continued)

OTHER PUBLICATIONS

European Patent Search Report EP 08 01 4387, Oct. 30, 2008.

(Continued)

*Primary Examiner* — Sarah Purol
(74) *Attorney, Agent, or Firm* — William W. Letson

(57) ABSTRACT

The present invention relates to dispensers for disposable cutlery. The invention also relates to banded packets of disposable cutlery that can be used in the cutlery dispenser of the present invention, as well as other cutlery dispensers that do not use a cartridge therein. The present invention also relates to disposable cutlery that has been adapted to make it better suited to stacking, such as for use in cutlery dispensers that do not include a cartridge.

24 Claims, 26 Drawing Sheets

U.S. PATENT DOCUMENTS 2,078,984 A 5/1937 Williamson
2,110,189 A 3/1938 Zeidler, Sr.
2,141,684 A 12/1938 Diemer
2,149,098 A 2/1939 Phinney
2,149,099 A 2/1939 Phinney et al.
2,188,573 A 1/1940 Longo
2,207,528 A 7/1940 Witt
2,239,196 A 4/1941 Lunvik
2,260,596 A 10/1941 Young
2,268,596 A 1/1942 Jerum
2,268,873 A 1/1942 Hopkins et al.
2,340,561 A 2/1944 Renfro
2,421,782 A 6/1947 Gibbs et al.
2,472,051 A 5/1949 Testi
2,571,668 A 10/1951 Booth et al.
2,577,344 A 12/1951 Masure
2,635,025 A 4/1953 Ziska
2,646,874 A 7/1953 Testi
2,671,555 A 3/1954 Shnitzler
2,692,691 A 10/1954 Harriss et al.
2,752,678 A * 7/1956 Welch ..... 30/324
2,868,344 A 1/1959 Shields
2,877,926 A 3/1959 Abbe
2,880,907 A 4/1959 Mainers
2,889,076 A 6/1959 Van Schie
2,911,127 A 11/1959 Driss et al.
2,924,357 A 2/1960 Kingsley et al.
2,946,431 A 7/1960 Nissen
2,954,948 A 10/1960 Johnson
2,965,262 A 12/1960 Du Bois
3,083,879 A 4/1963 Coleman
3,095,114 A 6/1963 Tobias
3,100,842 A 8/1963 Tellefsen
3,114,475 A 12/1963 Etes
3,132,765 A 5/1964 Florendo
3,163,327 A 12/1964 Maxwell
3,263,860 A 8/1966 Haas
3,300,087 A 1/1967 Kuypers
3,313,452 A 4/1967 Katz
3,334,784 A 8/1967 Morrison
3,371,821 A 3/1968 Abood et al.
3,407,927 A 10/1968 Jones
3,426,941 A 2/1969 Hovekamp
3,472,421 A 10/1969 Baller
3,499,538 A 3/1970 Sherard
3,558,006 A 1/1971 Redmond et al.
3,587,922 A 6/1971 Oriti
3,680,736 A 8/1972 Viessmann
3,786,959 A 1/1974 Greb et al.
4,134,519 A 1/1979 Barnett et al.
4,308,974 A 1/1982 Jones
4,489,854 A 12/1984 Wenkman et al.
4,524,512 A * 6/1985 Formo et al. ..... 30/147
4,570,536 A 2/1986 Dodd
4,571,773 A 2/1986 Yuda
4,574,423 A 3/1986 Ito et al.
4,610,087 A 9/1986 Mickelson et al.
4,614,004 A 9/1986 Oshida
4,662,536 A 5/1987 Powers
4,691,811 A 9/1987 Arakawa et al.
4,697,673 A 10/1987 Omata
4,715,514 A 12/1987 Vidondo
4,789,064 A 12/1988 Segal
4,896,792 A 1/1990 Marchand
4,973,037 A 11/1990 Holbrook
4,986,442 A 1/1991 Hinterreiter
5,127,546 A 7/1992 Chen
5,131,586 A 7/1992 Capy
5,191,997 A 3/1993 Squitieri
5,211,267 A 5/1993 Clark
5,249,705 A 10/1993 Gates
D342,648 S * 12/1993 Cautereels et al. ..... D7/653
5,269,397 A 12/1993 Kawamoto et al.
5,364,016 A 11/1994 Capy et al.
5,413,317 A 5/1995 Spoerre
5,449,054 A 9/1995 Wiese et al.
5,460,252 A 10/1995 Kosugi et al.
5,469,688 A 11/1995 Dunbar et al.
5,497,863 A 3/1996 Schmidt et al.
5,509,522 A 4/1996 Laidlaw
5,542,508 A 8/1996 Van Erden et al.
5,564,594 A 10/1996 Monfredo
5,586,685 A 12/1996 Dorner et al.
5,605,208 A 2/1997 Friedrichsen et al.
5,660,252 A 8/1997 Lafon
5,904,250 A * 5/1999 De Schutter ..... 206/553
5,921,408 A 7/1999 Groenewold et al.
6,023,913 A 2/2000 Gray et al.
6,047,830 A 4/2000 Chang
6,202,891 B1 3/2001 Mark
6,250,498 B1 * 6/2001 Lovejoy ..... 221/185
6,298,960 B1 10/2001 Derr
6,336,568 B1 1/2002 Tucker et al.
6,626,633 B2 9/2003 Jendzurski et al.
6,651,841 B2 11/2003 Tsuchida
D492,549 S 7/2004 Welch
D493,337 S 7/2004 Welch
6,763,972 B2 7/2004 Graupner
6,832,694 B2 12/2004 Goeking et al.
6,837,028 B1 1/2005 Miano et al.
6,840,353 B2 1/2005 Arisaka
6,945,427 B2 9/2005 Hieb
6,972,033 B2 12/2005 McNicholas
6,976,348 B1 12/2005 Miano et al.
7,210,279 B1 5/2007 Ahmed et al.
7,322,172 B2 1/2008 Hoffman et al.
D591,104 S * 4/2009 Oakes ..... D7/401.2
7,513,089 B2 4/2009 Rubin
7,520,247 B2 4/2009 Rutledge
2002/0112445 A1 8/2002 Scaduto
2003/0015824 A1 1/2003 Forbes et al.
2003/0146061 A1 8/2003 Tournier
2004/0045398 A1 3/2004 Hayashi
2004/0045860 A1 * 3/2004 Edgerly et al. ..... 206/504
2004/0089670 A1 5/2004 Goeking et al.
2005/0082307 A1 4/2005 Tucker
2005/0155229 A1 7/2005 Lee
2005/0252057 A1 * 11/2005 Lavi ..... 40/665
2006/0000190 A1 * 1/2006 Behnke et al. ..... 53/399
2007/0131705 A1 6/2007 Behravesh et al.
2007/0193968 A1 8/2007 Smith et al.
2008/0121650 A1 * 5/2008 Smith ..... 221/129
2010/0084418 A1 4/2010 Reinsel et al.
2010/0147869 A1 6/2010 Iliffe et al.

FOREIGN PATENT DOCUMENTS

CN 2865478 Y 2/2007
DE 7033238 U 11/1970
DE 7127677 U 11/1971
DE 3151268 7/1983
DE 4139938 A1 6/1993
DE 9316566 U1 1/1994
DE 19906369 C1 2/2000
DE 202005013647 U1 7/2006
EP 0856272 5/1998
EP 0856272 A3 1/1999
EP 1022107 A1 7/2000
EP 1217923 3/2003
EP 1217923 B1 9/2003
EP 1213985 6/2004
EP 1514497 A1 3/2005
EP 1719438 A1 11/2006
EP 1864596 A2 12/2007
WO 01/05280 1/2001
WO 01/05281 1/2001
WO 01/68492 A1 9/2001
WO 2004/028309 4/2004
WO 2004/028309 A1 4/2004
WO 2007/049982 A1 5/2007
WO 2007/124606 A1 11/2007
WO 2008/058187 A2 5/2008

OTHER PUBLICATIONS

PCT International Search Report PCT/US2007/083922, Nov. 17, 2008.
PCT International Search Report, Mar. 11, 2008.

PCT International Search Report, Jul. 8, 2008.
Written Opinion of the International Searching Authority for PCT/US2007/083922 of Nov. 17, 2008.
Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
Written Opinion for PCT/US07/83752, mailed Mar. 11, 2008, six pages, European Patent Office, Munich, Germany.
Partial International Search Report, mailed Jul. 8, 2008, two pages.
International Search Report and Written Opinion for PCT/US2009/059915, mailed Feb. 3, 2010, 13 pages, European Patent Office, Munich, Germany.
European Search Report for 06009258.2, mailed Jul. 24, 2006, five pages, Munich, Germany.
Office Action for U.S. Appl. No. 12/349,203 mailed Jun. 15, 2011.
Office Actions for U.S. Appl. No. 11/556,808, filed Nov. 6, 2006.
Office Actions for U.S. Appl. No. 11/936,401, filed Nov. 7, 2007.

* cited by examiner

Spoon and Knife right

Fork left

Spoon and Knife

Fork

DISPENSER FOR DISPOSABLE CUTLERY AND COMPONENTS THEREFOR

CROSS-REFERENCE TO RELATED APPLICATIONS

This application claims priority to U.S. Provisional Patent Application Nos. 60/678,365, filed May 5, 2005 and 60/736,622, filed Nov. 15, 2005, the disclosures of which are incorporated herein in their entireties by this reference.

FIELD OF THE INVENTION

The present invention relates to dispensers for disposable cutlery. The invention also relates to banded packets of disposable cutlery that can be used in the cutlery dispensers of the present invention, as well as in other cutlery dispensers that do not use a cartridge. The present invention also relates to disposable cutlery that has been adapted to make it better suited to stacking, such as for use in the cutlery dispensers that do not use a cartridge.

BACKGROUND OF THE INVENTION

Disposable cutlery, for example, plastic spoons, forks, knives and "sporks," (e.g., a combination of a spoon and a fork), are frequently used in informal restaurant settings and are provided for use with "take out" restaurant food. To ensure that this cutlery is provided in a hygienic form, it is often purchased by a restaurant or other facility pre-sealed in a pouch. A napkin and condiments i.e., salt and pepper, may be included in the pouch. Such pouches are generally more expensive than the individual utensils due to the processing and materials necessary to form the pouches. Also, these pouches may provide more cutlery or condiments than the user needs and, as such, may be wasteful.

An alternative to such prepared pouches is the presentation of cutlery for use in an unwrapped form, for example, in a bin or cup. As would be recognized, this allows the customer to select only the utensils desired. However, this form of dispensing can be considered by customers to be unsanitary and can indeed be unsanitary if a previous customer does not take a utensil she touched. The unregulated dispensing of the cutlery in this form also permits the user to take more utensils than intended, thus resulting in less profit for the establishment.

In view of the above problems with existing methods of providing disposable cutlery for use, there would appear to be a need for a method to provide disposable cutlery to a customer in a hygienic, economical and non-wasteful manner. To this end, there have been proposed various designs for cutlery dispensers that would dispense utensils in a hygienic and economical manner, however, cutlery dispensers have not gained widespread adoption. It is believed that prior art cutlery dispenser designs have not been widely used because of inefficient and uneconomical designs.

In particular, disposable cutlery designs typically comprise an external ridge or rim extending around the outer periphery of the handle with a thin web joined to medial portions of the external ridge or rim and extending between the piece. Such a configuration provides a relatively rigid, but low cost, utensil due to the fact that the polymer material is maximized on the utensil where it will most efficiently impart increased rigidity. The inventors herein have found that when disposable cutlery having this typical design is stacked, interactions between these ridges can make it difficult for one piece of cutlery to slide relative to another. The cutlery then becomes locked at the ridge which makes it difficult, if not impossible, to dispense the cutlery. This locking can be exacerbated when two pieces of cutlery are skewed and/or interlocked while being weighted down by several dozen to possibly even 150 or more pieces of cutlery that is stacked above these two pieces of cutlery. Such interlocking can interfere with or wholly prevent efficient dispensing.

Further, some disposable spoon designs incorporate deeper ribbing at the junction between the food contact portion and the handle. This ribbing is included in order to impart extra strength to the relatively thin neck area. Such design features have been found by the inventors herein to typically prevent a stack of spoons from stacking efficiently; rather, the cutlery will stack in a "fanned" orientation which further reduces the ability to dispense the cutlery using prior art designs. It is believed by the inventors herein that such stacking difficulties would also be present with sporks.

A wide variety of dispensers have been previously used for the dispensing of products having a generally rounded shape overall such as, for example, soda straws, matches, coffee stirs and toothpicks. Such dispensers for overall rounded shapes are typified by the following U.S. Pat. Nos. 6,202,891; 4,489,854; 3,587,922; 3,472,421; 3,313,452; 3,263,860; 2,239,196; 2,207,528; 1,675,510; 1,504,098; 1,355,583; 999,837; 925,485; and 592,105. The disclosures of each of the foregoing patents are incorporated herein in their entireties by this reference.

In contrast, dispensers for cutlery proposed by the prior art are usually considerably more complex than the designs illustrated in the referenced patents. In particular, the more complex design features of disposable cutlery (such as the ridges and non-uniform shapes discussed previously) have not been found to allow reliable and consistent dispensing using prior art designs. In general, many prior art cutlery dispenser designs are believed to have incorporated cartridge-type systems wherein the cutlery was pre-loaded into a holder i.e., the cartridge, prior to shipment to the end user. For example, U.S. Pat. Nos. 4,134,519 and 6,336,568 (incorporated by reference herein) disclose cutlery dispensers using cartridges. As would be recognized, use of such a cartridge will assist in providing hygienic dispensing, but this design incorporates an expensive cartridge which must be disposed of when emptied. Further, this design cannot be filled easily by the end-user and will need to be emptied fully before replacing the cartridge with a new one. Alternatively, to ensure that the dispenser does not become empty during inopportune times (such as during lunch rush hour in a restaurant), the cartridge might be replaced prior to its being fully empty. The former was problematic because the dispenser can run out of cutlery and frustrate the customer. The latter was problematic because the partially full cartridge would be emptied before all of the cutlery pieces were used. Regardless of when the cartridge might be re-filled, the use of a cartridge system can be expensive and wasteful and likely would substantially increase the cost of supplying disposable cutlery to an end user.

In U.S. Pat. No. 6,832,694 (incorporated by reference herein), a cartridge-type cutlery dispenser is illustrated in which, upon dispensing, the lowermost item of cutlery in the stack slides longitudinally and downwardly with respect to the other items in the stack and thus can be removed without lifting the stack above it by a significant distance. Such an arrangement requires a relatively minimal dispensing force and promotes easy and reliable dispensing. While the '694 patent design does not include an expensive and wasteful cartridge, it nonetheless requires the utensils to be individually reloaded into the dispenser. Such reloading is time consuming (which increases labor costs for the establishment)

and, if incorrectly loaded, the dispenser could be prone to jamming. Also, if the person loading the dispenser has not washed her hands prior to loading, the utensils will become soiled or, worse, germ-ridden. Thus, the dispenser of the '694 patent does not readily provide an economical and hygienic cutlery dispenser.

Other cutlery dispensers in the prior art are not designed for disposable cutlery and therefore are not suitable to provide the desired features. Such non-disposable cutlery dispensers are exemplified by U.S. Pat. Nos. 2,188,573, 2,268,596 and 3,132,765, the disclosures of which are incorporated herein in their entireties by this reference.

In view of the above, it is apparent that there is a need for a device to dispense disposable cutlery in a hygienic, economical and non-wasteful manner. Still further, it would be desirable to provide a method to arrange disposable cutlery to allow quick and economical loading of cutlery in a cutlery dispenser for use. Yet further, it would be desirable to provide disposable cutlery with design features that facilitate the stacking and dispensing of cutlery in a cutlery dispenser. The present invention accomplishes these objectives.

SUMMARY OF THE INVENTION

The present invention relates to dispensers for disposable cutlery. The invention also relates to banded packets of disposable cutlery that can be used in the cutlery dispenser of the present invention, as well as in other cutlery dispensers that do not include a cartridge. The present invention also relates to disposable cutlery that has been adapted to make it better suited to stacking in cutlery dispensers that do not include a cartridge.

Additional advantages of the invention will be set forth in part in the detailed description, which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory aspects of the invention, and are not restrictive of the invention, as claimed.

BRIEF DESCRIPTION OF THE DRAWINGS

FIG. 37*a* illustrates version of the cutlery dispenser having a flexible retention rail.

FIG. 38 illustrates the spanning crossbar inserted between ridges on the backside of the junction of the spoons.

FIGS. 42, 43, and 44 illustrate configurations for a form of flexible bands used to bind disposable spoons, forks and knives, respectively.

DETAILED DESCRIPTION OF THE INVENTION

Figure 1:
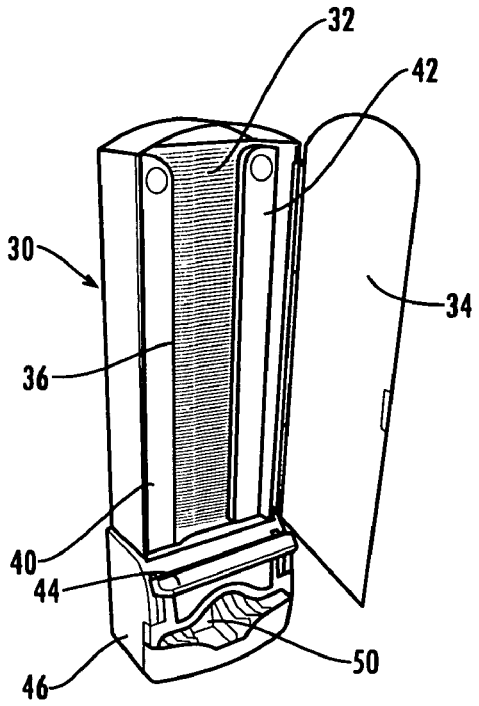
FIG. 1 illustrates one example of a dispenser of the present invention having its front door open and loaded with a stack of cutlery ready for dispensing.

The present invention may be understood more readily by reference to the following detailed description of the invention and the Figures provided herein. It is to be understood that this invention is not limited to the specific methods, formulations, and conditions described, as such may, of course, vary. It is also to be understood that the terminology used herein is for the purpose of describing particular aspects only and is not intended to be limiting.

In this specification and in the claims that follow, reference will be made to a number of terms, which shall be defined to have the following meanings.

The singular forms "a," "an," and "the" include plural referents unless the context clearly dictates otherwise.

Ranges may be expressed herein as from "about" one particular value and/or to "about" or another particular value. When such a range is expressed, another aspect includes from the one particular value and/or to the other particular value. Similarly, when values are expressed as approximations, by use of the antecedent "about," it will be understood that the particular value forms another aspect.

"Optional" or "optionally" means that the subsequently described event or circumstance may or may not occur, and that the description includes instances where said event or circumstance occurs and instances where it does not. For example, the phrase "cutlery optionally comprises a stack lug" means that the lug may or may not be present on the cutlery and that the description includes both cutlery having the lug and cutlery not having the lug.

"Disposable cutlery" means any cutlery intended for about one use by the provider thereof, although the cutlery can be used more times as desired by the end user. Such cutlery can be comprised totally or substantially totally from polymeric materials, such as polystyrene. Methods of making disposable cutlery are known and are not described in detail herein. Disposable cutlery can also be prepared from filled polypropylene as described in U.S. patent application Ser. No. 10/227,977 (U.S. patent publication No. 2003/0015824, now abandoned), the disclosure of which is incorporated herein in its entirety by this reference. In a further form, the present application does not relate to non-disposable cutlery.

"Packet" is used to denote a banded stack of cutlery. "Stack" refers either to the cutlery within a band or an unbound arrangement of cutlery within a cutlery dispenser as indicated by the context.

Unless the context clearly indicates otherwise, the terms "cutlery" and "utensil" are used herein interchangeably to mean a fork, knife, spoon (including a soup spoon), or spork or other types of cutlery intended to be disposable.

In one form, the cutlery dispenser of the present invention provides an economical, hygienic and reliable dispenser for disposable cutlery. The cutlery dispenser of the present invention allows quick re-filling as needed. Still further, the cutlery dispenser of the present invention incorporates a design that can be easily mounted against or on a wall to maximize space usage in a restaurant or other location.

In a further form, dispensing of disposable cutlery is consistently and reliably accomplished by dispensing a first piece of cutlery (or first utensil) from the bottom of a stack of disposable cutlery. A feature of the present invention is the incorporation of an element that reduces the tendency of the disposable cutlery to interlock—a phenomenon that typically prevents disposable cutlery from dispensing in a consistent and reliable manner.

Regardless of whether a rotatable cam or rocking cam arrangement is used as the dispensing mechanism in the cutlery dispenser (each of which is discussed in detail later), to load the cutlery dispenser of the present invention, a banded configuration of pre-aligned disposable cutlery (i.e., a cutlery packet) is placed in the dispenser with the band still in place. This band allows the disposable cutlery to be suitably provided in a convenient form for loading and dispensing as discussed further in detail below. The band keeps the cutlery stack in substantial vertical alignment during storage so that the stack may be readily loaded into the cutlery dispenser for use. The band can be removed after the packet has been loaded into the cutlery dispenser without unduly disturbing the alignment of the items of cutlery within the dispenser so as to keep the utensils in the stack in substantial vertical alignment. This markedly assists in ensuring consistent and reliable dispensing. The banded arrangement is suitable for use with the cutlery dispenser of the present invention. It is contemplated that the banded arrangement of disposable cutlery will also be suitable for use with other forms of non-cartridge cutlery dispensers hereinafter developed.

In one form, the cutlery dispensers of the present invention comprise a housing that is durably mounted on a stand. The cutlery dispenser can also be provided without a stand. The cutlery dispenser can be mounted on a wall to save space or placed on a counter or other location in an establishment for use. As noted, the present design is superior to prior art cutlery dispensers that included a large dispensing area and, thus, required substantial space for use in an establishment. The design of the present invention incorporates a relatively small dispensing area, thus making the overall dispenser very space efficient. Such space saving is very desirable in a food service setting, as would be readily appreciated.

The interiors and exteriors of the cutlery dispenser can be made from metal or from a polymer material or a mixture thereof. The type of material is not critical to the invention, however, at this time it is believed that the dispenser will be composed of both polymer and metal as dictated by the specific features of the cutlery dispenser.

The housing of the cutlery dispenser can include a hinged door opening. Such a door has been found to improve, in some forms, the ability to load the cutlery dispenser. It has been further found that the presence of a door can assist in the ability to clean the inside of the cutlery dispenser. The door can be opaque or see-through. If see-through, it is desirable that the door comprise a polymeric material that can be made translucent or transparent, such as polycarbonate.

At the top portion of the cutlery dispenser, there can also be a hinged door. When kept closed, the hinged door can assist in keeping the cutlery clean while loaded in the cutlery dispenser. Alternatively, the top of the cutlery dispenser can be sealed. Still futher, the hinged door and the top of the cutlery dispenser can be integrally formed.

Since the various internal components of the cutlery dispensers may be sized differently to more readily accommodate different types of cutlery (e.g., forks, knives, spoons and sporks), it can be helpful to clearly mark the cutlery dispenser with a description of the utensil for which the dispenser was designed. For example, the fork dispenser can be clearly marked "forks" in writing and/or by picture. To assist in filling, the utensil designation can be on the interior (that is, visible only when the cutlery dispenser door is opened) or it can be on the exterior. It may also be beneficial to designate the type of cutlery in the dispenser to a restaurant customer, such as by clearly marking on the outside of the housing in writing and/or pictures legible to a restaurant customer.

It can also be useful to provide written instructions with the cutlery dispenser to assist in loading and use. Loading instructions can be printed inside the housing and use instructions can be printed outside of the housing.

In one form, individual pieces of cutlery are dispensed from the cutlery dispenser via forward or substantially forward movement of at least two rotatable cams mounted on an rotatable shaft. This substantially forward movement is provided by a one-way bearing located within the rotatable shaft. Such one way bearings are well known to one of ordinary skill in the art and are not described in detail herein.

The rotatable cams can be configured to be associated with the type of cutlery being dispensed. Alternatively, one or more types of disposable cutlery are dispensable using the same rotatable cam design. For example, a single rotatable cam design can be suitable for use with a spoon and knife, whereas a spoon or spork may benefit from a different type of rotatable cam design due to the deeper depressions used on this utensil as a result of the design features of these utensils. In separate examples, the rotable cam can have from about 5 to about 20 depressions, or ridges, around the circumference of each cam. Still further, the cams can have about 5, 8, 10, 13, 15, 18, or 20 depressions, where any value can serve as an upper or lower endpoint, as appropriate. The circumference of the cam is dictated, in part, by the desired overall size of the cutlery dispenser. The cams can be prepared from metal or polymer or other material, as long as the material selected is durable enough for use in the cutlery dispenser. Examples of suitable rotatable cam designs having about 10 depressions are illustrated in FIGS. 41*a*, 41*b*, 41*c* and 41*d* which are discussed in more detail below.

In one form of the rotatable cam configuration cutlery dispenser of the present invention, it has been found that a first utensil (that is, the piece of cutlery closest to the dispensing area of the cutlery dispenser so as to be the bottommost utensil in the stack) can be supported in depressions formed in the rotatable cams as pictured in FIGS. 41*a*, 41*b*, 41*c* and 41*d*. In particular, the at least two rotatable cams can be mounted on an rotatable shaft. The depressions in a first rotatable cam can be exactly or almost exactly matched with a corresponding depression on a second rotatable cam, where the first and second rotatable cams are mounted on the rotatable shaft. Still further, a second rotatable cam can be skewed in relation to a first rotatable cam. Such skewing has been found, in some circumstances, to facilitate dispensing of some cutlery designs. In this skewed form, the depressions on adjacent cams will not be exactly or almost exactly matched.

Regardless to whether the cams are matched or not, the rotation of the cam arrangement with each advance of the accuating handle corresponds to the distance necessary to present the first utensil to the user from the dispensing position and to advance the second utensil into the first utensil dispensing position.

The distance between the at least two rotatable cams is a distance that corresponds approximately to a location immediately to the inside of the food contact portion of the particular utensil to be dispensed and a minimal distance within the length of the handle. In separate examples, the rotatable cam is positioned closest to the end of the handle of the cutlery and is from about 5, 10, 15, 20 or 25 percent of the distance from the end of the handle such that the handle overspans the outer end of the rotatable cam in the stated percent of the handle. The distance between the rotatable cams (that is, the distance the defined by the rotatable shaft portion between the rotatable cams) is not critical and would be expected to vary for differently sized cutlery pieces. For example, the length of a knife can vary; for knives having larger handles, the rotatable cams may be spaced farther apart. In some forms, three or four rotatable cams can be placed on the rotatable shaft, with each of the depressions in the respective rotatable cams being matched closely or exactly with the depressions on the other rotatable cams.

In a further form of the rotatable cam design, the individual utensils are dispensed from the cutlery dispenser by actuating a spring that is attached to a handle, wherein the handle is mounted directly or indirectly to the rotatable shaft upon which the two rotatable cams are mounted. As noted, a one way bearing can be situated in the rotatable shaft to ensure that it moves the rotatable cams in a substantially or totally in a forward direction. To dispense a piece of cutlery, a user (such as a restaurant customer needing a piece of disposable cutlery), pushes down on or engages the handle. This force actuates the spring which is engaged with the rotatable shaft. In turn, this causes the at least two rotatable cams to move forward. When a stack of cutlery is properly loaded into the dispenser (that is, when the first utensil is positioned in the respective depressions on the at least two rotatable cams), the first piece of cutlery will move forward for presentation to the customer for use. When the rotatable cams move forward to present the first utensil, the next utensil in the stack (which was previously the second utensil) will move into the respective depressions in the rotatable cams so as to now become the first utensil. As will be recognized, further pushing of the handle by the user will result in presentation of this first utensil for dispensing and the second utensil now moves forward on the rotatable cams to now become the first utensil. This process will repeat as long as there is a stack of cutlery in the cutlery dispenser.

While the rotatable cam design described previously has been found exceedingly effective in reliably and consistently dispensing cutlery loaded into the dispenser in a banded packet form (as discussed below), a rocking cam form has also been found to allow reliable and consistent dispensing. In this form, the first utensil in the stack can be guided into a dispensing position of the dispenser by way of a profile plate. The profile plate can have an aperture with a shape conforming either partially or fully to the utensil to be dispensed. Such a shape has been found to allow a single utensil to be positioned properly for dispensing. In such a form, utensils above the first utensil are partially supported and/or guided into alignment with the first utensil by guide ramps above said aperture as well as other alignment features built into the structure above the profile plate. In one form, outwardly and upwardly flaring guide ramps can be located above this aperture.

Still further, the flexible profile plate need not be present in the rocking cam form cutlery dispenser of the present invention. In one such example, a flexible retention rail can operate to allow a piece of cutlery to be dispensed. In use, the flexible retention rail moves forward when the rocking cam presents the first utensil. The first utensil is released from the clearance shelf of the rocking cam. The flexible retention rail then moves backward with the rocking cam to a resting (or "home") position. This action is illustrated in FIGS. 37*a*-37*d*.

In the rocking cam configuration, there can be at least two or at least three or at least four or at least five separate cams arranged on a rotatable shaft. Each of these rocking cams will have depressions incorporated thereon in a manner that are suitable for dispensing utensils in a consistent and reliable manner. These depressions can be of the same shape or different on the separate rocking cams. The depressions can be right angles or generally right angles. The rocking cams can have lateral displacement surfaces to assist in forward motion of the utensil. The rocking cams can also have a clearance shelf by which the utensils are pushed forward during dispensing. The rocking cams are spaced to correspond to the length appropriate to allow efficient dispensing of the utensils. The spacing is comparable to that discussed previously for the rotatable cam configuration.

The rocking cams and rotatable shaft can be made of metal, polymer material or a mixture of both. The various configurations and materials best suited for use in the rocking cam configuration can be readily determined by one of ordinary skill in the art without undue experimentation.

Further in relation to the rocking cam example of the cutlery dispenser, the first utensil in the cutlery stack can rest on a support shelf closely adjacent to a rocking cam surface. This rocking cam is partially rotatable about a rotatable shaft positioned generally parallel to the longitudinal axis of the cutlery item to be dispensed. Upon partial rotation resulting from engagement of the actuating handle by a user, the first utensil will be displaced from the support shelf and directed to a dispensing chute. When the utensil is dispensed, the cam moves backwards so as to permit dispensing of the next utensil in the stack. Since the cam rotates only partially about the rotatable shaft and rotates back upon dispensing of a utensil, this cam arrangement is referred to herein as the "rocking cam."

Figure 19:
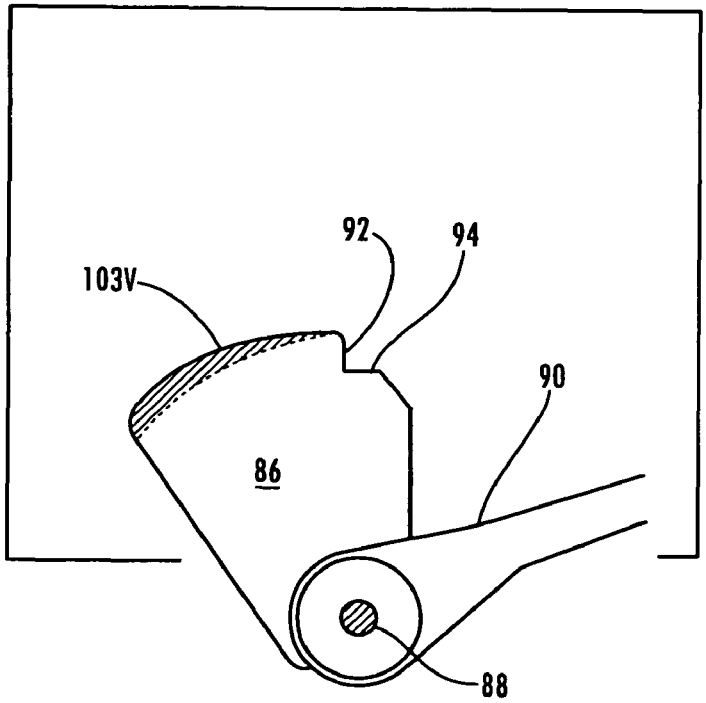

In various forms, the rocking cam surface can be configured to displace the first utensil in a cutlery stack into lengthwise or approximately lengthwise alignment with a suitable dispensing location. A portion of a profile plate adjacent the neck of the utensil to above the utensil to be dispensed can flex upon contact with the utensil after rotation of the rocking cam so as to allow the first utensil to slip primarily laterally from beneath the items above it while imparting a slight cant (rotation about the longitudinal axis) to the utensil above to facilitate separation when required. Yet further, the rocking cam surface can be adapted to lift the cutlery stack above a first utensil while the first utensil is being displaced laterally. This lifting is illustrated in FIG. 19. Still further, the profile plate need not be present to allow efficient dispensing.

Movement of the rocking cam is effected by an actuating handle. In use, a user pushes or pulls the actuating handle when she desires to dispense a utensil. The actuating handle is directly or indirectly engaged with the rotatable shaft such that this pushing or pulling motion causes the rotatable shaft to rock in a direction that allows the utensil to be dispensed as described further herein. When the actuating handle is released by the user, the rocking cam is returned to a first position, which is the position the rocking cam is at rest. Upon reaching the first position, the first utensil (which was previously the second utensil) becomes situated in the rocking cams. When returning to this first position, it was been found that the rocking cam can be configured to provide a bumping or jostling of the cutlery stack so as to reduce the tendency for the individual utensils in the stack to interlock with each other. This has been found by the inventors to assist in providing reliable dispensing. When paired with a profile plate, in particular a flexible profile plate, wherein the profile opening is contoured to guide the second utensil into position primarily laterally as the stack is raised and lowered during each dispensing cycle, the present invention has been found to provide consistent and reliable dispensing. Still further, the profile plate need not be present, especially when a flexible retention rail is used (as is discussed elsewhere herein).

In one form, guide ramps above the profile plate can flare upwardly and outwardly above the medial plane of the first utensil when the rocking cam is in the first position. It is believed that the upwardly and outwardly flaring portions of the guide ramps above the profile opening can serve, along with the profile opening itself, to position the first utensil in the stack in a suitable lateral position. The flexible portion of the contour plate is believed to help reduce the incidence of jamming when the lower rim on the third utensil (that is, the utensil above the second utensil) might otherwise become wedged between the upper rim on the first utensil and the forward wall of the profile opening.

Whether the rotatable cam or rocking cam arrangement or other arrangement is used, guide rail inserts can be configured such that a storage chute is defined within the housing of the cutlery dispenser above the cam arrangements. The storage chute defined by the guide rail inserts should be positioned to ensure that upon advancement of the first utensil over the dispensing area, the second utensil advances to become the first utensil.

Moreover, the guide rail inserts should be configured to accommodate a stack of cutlery with the central portions of the cutlery stack in the dispenser being accessible so that a banded packet of cutlery (as discussed further herein) can be lowered and accurately positioned into the storage chute. That is, the openings of the guide rails should readily allow the end of the utensil handles and the portion of the handle adjacent to the food contact portion of the cutlery pieces to slide within the cutlery dispenser housing readily and with minimal catching within the cutlery dispenser.

The inventors herein have determined that, in some forms, it can be beneficial to define a storage chute to closely approximate the profile of the cutlery to be dispensed. Therefore, the guide rails can be shaped to best accommodate the design and type of cutlery to be dispensed. Moreover, it is contemplated that, in some examples, the guide rails can be removable from the cutlery dispenser. It is anticipated that guide rails can be made to be removable and insertable into a cutlery dispenser so as to allow an attendant to dispense differently shaped cutlery designs as needed. In separate examples, the guide rails are sized specifically for forks, knives, spoons, sporks, or other types of cutlery that are disposable. A single guide rail may be suitable in some circumstances.

In a further significant form, the invention comprises an arrangement of disposable cutlery suitable for use in the cutlery dispenser of the present invention. In one form, the stack of disposable cutlery is banded to present the stack for use in the dispenser of the present invention or other non-cartridge-type cutlery dispensers. It has been found that the banding of the stack allows the cutlery stack to be constrained during shipping and storage. Still further, it has been found that the band allows a significant number of pieces of disposable cutlery to be reliably presented for loading into a non-cartridge-type cutlery dispenser.

In particular, the banded packet of a number of utensils of the same type (e.g., forks, knives, spoons or sporks) is positioned within the storage chute of the cutlery dispenser. The band will subsequently be removed thus providing a dispensable stack of disposable cutlery in substantial alignment in the storage chute.

As noted, the individual utensils will be provided in this banded packet for use. The number of cutlery pieces in each banded packet is not critical to invention. However, it will be appreciated that the number of cutlery pieces that can be provided in each banded packet for use can be configured for maximum efficiency. Accordingly, the banded packet of disposable cutlery can comprise from about 20, 30, 40, 50, 60, 80, 100, 120, 150, or 200 pieces of cutlery, where any value can form an upper or lower endpoint, as appropriate. It is also contemplated that the banded packets can have smaller banded packets incorporated therein. Thus, a large stack of, for example, 150 pieces of cutlery, can also include smaller banded portions of cutlery, for example, three bands of 50 pieces of cutlery. The smaller banded packets can be separated from the larger band to allow the cutlery dispenser to be topped off more efficiently.

Each banded cutlery packet will comprise a single type of utensil. In one form, the cutlery stack comprising the banded packet will comprise spoons. In a further form, the cutlery stack comprising the banded packet will comprise forks. Still further, the cutlery stack comprising the banded packet will comprise knives. In a still further form, the cutlery stack comprising the banded packet will comprise sporks. Still further forms of cutlery can be stacked as described herein as long as only one type of cutlery is included in a single banded packet. In contrast to the stackable cutlery of U.S. Pat. No. 4,524,512, the disclosure of which is incorporated herein in its entirety by the reference, the different types of cutlery are not stackable or nestable together. That is, spoons will only be stackable or nestable with spoons and not forks or knives or sporks, and so on.

Regardless of the type of cutlery to be provided for use in the cutlery dispenser, each of the stacks will be secured by at least one band prior to loading into the cutlery dispenser. The at least one band can be comprised of paperboard, polymer or a mixture thereof. In one example, the band can comprise a strip of paperboard disposed on an interior side (the side facing away from the user when the stack is placed in the cutlery dispenser) of the cutlery stack and a polymeric band on an exterior side (the side facing toward the user when the stack is placed in the cutlery dispenser). The packets can be marked "front" and/or "back" as appropriate to assist in loading.

In one form, the at least one band can comprise a flexible strip of polyethylene, polyester, cellophane, flat paper, nylon or any similar flexible substrate capable of bearing and retaining a high-release adhesive. The at least one band can be from about 0.05 to about 4 inches in width, or from about 1.0 to about 3.0 inches in width. The width is defined by the need to prepare a tight bond in the packet and the need to be able to readily remove the band for use in the cutlery dispenser of the present invention. It is possible that the at least one band will need to be smaller or larger to account for the specific shapes of the cutlery being bound and the number of cutlery pieces being stacked together. These details will be readily determinable through routine experimentation. There can also be two or three bands around a single cutlery stack to provide the packet.

As noted, the at least one band can be used to join the ends of a paperboard portion of the band on the exterior side of the cutlery stack. To keep the stack tightly bound prior to use, an interior surface of the at least one band can be coated with a high release adhesive so as to provide a tape that is effective to bind the stack.

In one example, Arclad® 90604 (Adhesives Research, Glen Rock, Pa.) can be used. This tape product includes an accepted food contact compatible adhesive. Another tape that can be used is S788 (Specialty Tapes, Franksville, Wis.) which is a polyester coated with a food contact adhesive. Still further, it is believed not be necessary to use a food contact acceptable adhesive because the tape typically will not come into contact with food in use. More significantly, the adhesive used to prepare the tape must be able to provide a residue free or substantially residue free surface on the cutlery after the tape is removed. As would be appreciated, if a residue remains on the cutlery after the tape is removed, the cutlery will feel sticky in use, which is highly undesirable. Since the cutlery stacks will be subjected to a wide range of temperatures (e.g., Arizona in Summer; Alaska in Winter), the adhesive used on the tape should be able to provide a tight, residue-free or substantially residue-free bond at a wide range of temperatures, for example, from about 0° C. to about 50° C., or from about 20° C. to about 40° C. As used further herein, an adhesive with such properties is referred to as a "high release adhesive."

Acceptable adhesives for use in the tapes herein can have a cohesion (shear holding power) as determined in accordance with a modified to PSTC-7 ("Pressure Sensitive Tape Council") (incorporated by reference herein) of at least about 30 minutes at 500 g shear based on the time required for a static loaded tape sample to separate from a standard flat surface in a direction essentially parallel to the surface to which it has been fixed with a standard pressure. In this method, a coated strip (0.5"×3') is applied to a stainless steel plate and a 500 gram weight is attached to the bottom of the film. The steel panel with the coated strip attached is held in a rack such that the panel forms an angle of 178 to 180°. The time, in minutes, required to total failure of the test strip at 23° C. is recorded as the shear strength.

Acceptable adhesives for use in the tapes herein can have an adhesion (peel strength) of at least about 1.6 lb/in as determined in accordance with PSTC-1 (incorporated by reference herein) in which a 2.5 cm width of coated sheet is applied to a horizontal surface of a clean, stainless steel test plate with at least 16 cm of coated sheet material in firm contact with the steel plate. A hard rubber roller is used to firmly apply the strip and remove all discontinuities and entrapped air. The free end of the coated strip is then doubled back nearly touching itself so that the angle of removal from the steel plate will be 180°. The steel panel and the free end of the coated strip are then attached to the jaw of tensile tester. The jaw with free end of coated strip moves away at the rate of 300 mm per minute. The force required to remove the $2^{nd}$ and $3^{rd}$ inches of the coated strip is recorded as the peel strength.

Acceptable adhesives for use in the tapes herein can have a Rolling Ball Tack of at least about 31" as determined in accordance with PSTC-6 (incorporated by reference herein) in which a steel ball is released at the top of a standard incline, allowed to accelerate down the incline and roll onto a horizontal surface covered with a pressure sensitive adhesive. The distance that the stainless steel ball travels in inches on the adhesive film is measured and recorded as the rolling ball tack.

Figure 3:
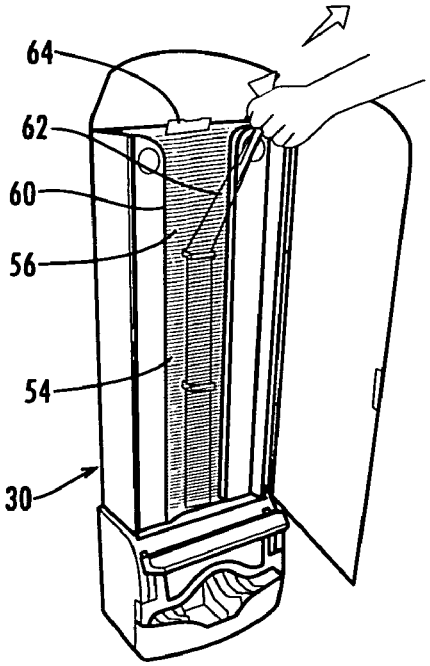
FIG. 3 illustrates removal of the banding around the topmost cutlery packet.
Figure 4:
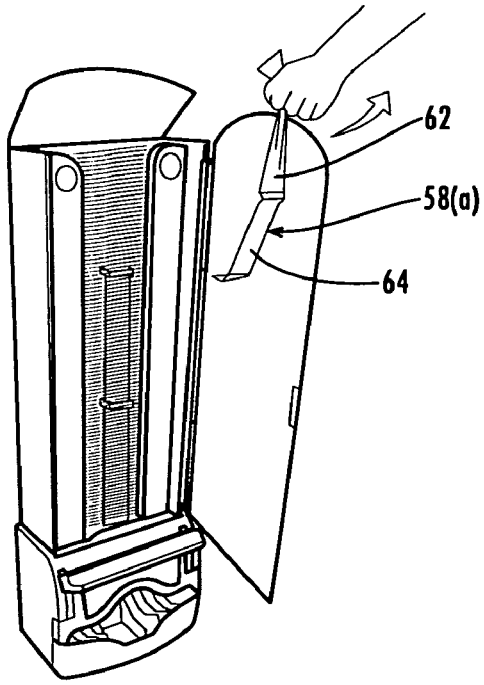
FIG. 4 illustrates the dispenser and banding of FIG. 1 after that banding has been removed from the topmost cutlery packet.

In use of the paperboard/polymer example, the user (such as an employee of the food service establishment) will place a cutlery packet in the storage chute of the dispenser with the tape side of the at least one band facing the front of the cutlery dispenser (facing the user). She will then exert a pulling force on the tape to separate it from a top side of paperboard band at the upper end of the stack so as to peel the tape downwardly toward the bottom of the stack. This motion is illustrated in FIG. 3. It will then be possible to slip the paperboard from between adjacent stacks situated in the cutlery dispenser without substantially disturbing the alignment of the other stacked utensils in the dispenser. This is illustrated in FIG. 4. In this form, the dispenser, which is generally configured to hold approximately 100 to 200 utensils, can be "topped off" at such times as may be convenient without wasting of an expensive cartridge and the contents thereof. Further, the removable bands orient the cutlery for placement in the cutlery dispenser and are easily disposable with negligible environmental impact. In a significant form, the cutlery stacks of the present invention are not arranged in a cartridge prior to dispensing thereof.

In a further example, the at least one band can be comprised totally of paperboard. In this example, the paperboard band can be tightly wrapped around the cutlery stack with the ends adhered with adhesive or tape. The flexible paperboard strip can include a perforation on the exterior side thereof. After placement of the cutlery packet in the dispenser, a user can tear the band at the perforation and slip the band from around the stack to allow use of the cutlery in the dispenser. When the band is removed from the stack after loading in the cutlery dispenser, a cutlery stack loaded into the dispenser is not substantially disrupted. In other words, upon removal of the band from the stack, the cutlery stack remains in substantial vertical alignment in the cutlery dispenser.

Still further, the at least one band can be comprised totally of a polymeric material. The polymeric material can be as noted previously. The polymeric material can have sealed ends (to form a loop) prior to use. In this form, the at least one band can be slipped over a portion of disposable cutlery to form a stack suitable for use in a cutlery dispenser. The polymeric material can also be positioned around a portion of disposable cutlery, followed by sealing of the ends to form a stack. In use, the bound cutlery stack can be placed in the cutlery dispenser, and the flexible band can be cut or torn and removed from the stack of cutlery so as to present the disposable cutlery for use in a cutlery dispenser. Also, it is believed that such banded configurations will be useful with other non-cartridge-type cutlery dispensers hereinafter invented.

With the banded structure of the cutlery stacks of the present invention, it has been found by the inventors herein that the first utensil (that is, the utensil situated closest to dispensing opening of the cutlery dispenser) will typically be in substantial alignment with the second utensil (that is, the utensil immediately above the first utensil) within the cutlery dispenser housing. In this form, the inventors have found little difficulty is experienced in dispensing the utensil with the cutlery dispenser of the present invention. This has been found to result in consistent and reliable dispensing of cutlery when used in combination with the cutlery dispenser described herein.

It is contemplated that disposable cutlery of a multitude of designs can be used in the dispensers of the present invention, as long as the molds used to prepare the cutlery are machined to tight tolerances. Since a plurality of cutlery pieces are prepared in single or multiple molds for later banding and stacking of the individual molded utensils, it can be important to make the cutlery as closely matched in dimensions as possible. When the dimensions of the cutlery are matched closely, it has been found that more uniform stacks (and banded packets) of cutlery can be obtained. Such more uniform (or straighter) stacks have been found to be more readily placed within a dispenser and, in some circumstances, less likely to become stuck in the dispenser during use.

Moreover, it may be useful to add certain design features to cutlery pieces to assist stacking of the utensils for dispensing. In particular, in some forms, it can be beneficial to place a stacking lug on the end of the handle to assist in more uniform stacking of irregular shaped cutlery designs. In one example, the addition of this stacking lug to a spoon has been found to reduce the tendency of a stack of spoons to assume a fanned shaped. (See, for example, FIG. 32). Accordingly, in one form, the present invention comprises a cutlery piece having a stacking lug located on an handle thereof. One form of this stacking lug is shown on in FIGS. 33 and 34. Such a stacking lug can also be present on a fork, a knife, a spoon or a spork. In contrast to the cutlery designs of U.S. Pat. No. 4,524,512 (previously incorporated herein), the cutlery design of the present invention has a single stacking lug at the end of the handle. The design of the '512 patent includes stacking lugs along the side of the handle which appears to be a necessary design feature of the stackable and nestable cutlery of the '512 patent.

The inventors herein have also determined that utensils can be more easily dispensed if a leveling promontory is provided, generally in the handle region, to provide the utensils that are less likely to assume a fanned shape when stacked. Particularly with spoons, it has been found that the typically pronounced ridges joining the bowl of the spoon to the neck make the spoons effectively much thicker close to the neck/bowl interface. Thus, the stacks of the spoons "fan" as the handles are typically effectively much thinner. It has been found that by providing a leveling promontory in the handle region, this tendency for the spoons to stack in a "fan" configuration can be minimized, thereby greatly aiding the dispensing thereof. In general, it has been found that satisfactory results are obtained if the leveling promontory takes a frustospheroidal shape or a truncated portion of a spheroid, such as perhaps a hemispheroid or some smaller portion of a spheroid, such as a quarter of a spheroid. It has also been found that interlocking can be alleviated between the pronounced ridges found at the junction of the bowl and handle of a spoon by inserting a spanning crossbar (that is, the leveling promitory) between these ridges to hinder interpenetration of the ridges on one spoon between the ridges on another.

The individual pieces of cutlery can be arranged into a stack form in either an automated or hand process. The technology needed to prepare the banded packets of the present invention is within the knowledge of one of ordinary skill in the art and, as such, is not discussed in detail herein. In summary, a plurality (such as 40, or 50, or 75 or more) of a single type of cutlery is placed within a storage chute in the cutlery dispenser. A paperboard/tape band is placed around the plurality and the tape engaged with the appropriate part of the stack to allow the band to be removed from the cutlery stack as described herein.

Referring now to the drawings, FIG. 1 illustrates loaded dispenser 30 for cutlery 32 having hinged front door 34 open revealing a stack 36 of cutlery 32 therein confined between left guide channel 40 and right guide channel 42. Front actuating handle 44 is pivotably mounted in base 46 just forward of dispensing chute 48 (not shown) above dispensing opening 50.

Figure 2:
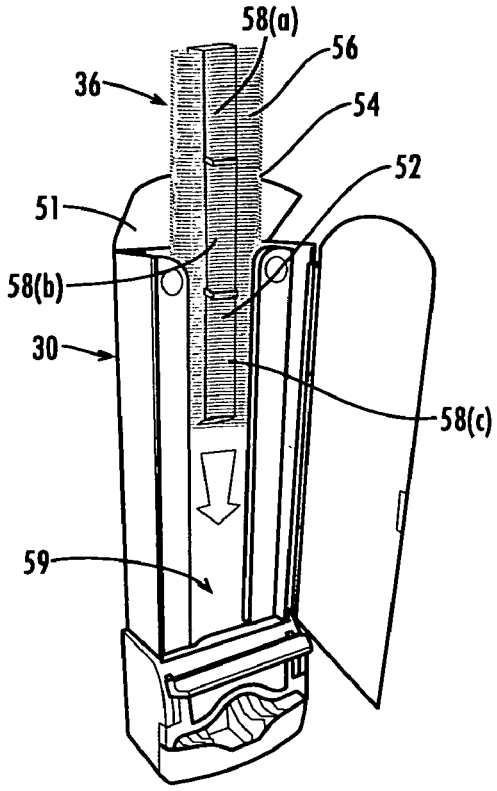
FIG. 2 illustrates loading of the dispenser of FIG. 1 with both the front and top doors open wherein three banded of cutlery packets are being inserted through the top at the same time.

In FIG. 2, top door 51 of dispenser 30 has been opened as stack 36 comprising three separate packets 52, 54 and 56 of cutlery, each respectively surrounded by band 58 (58*a*, 58*b* and 58*c*), is inserted in storage chute 59. In most cases, each packet 52, 54 or 56 would be placed in storage chute 59 of dispenser 30 sequentially; or, commonly, a single stack, for example, packet 56, would be used to "top-off" as the stack becomes partially depleted.

In FIG. 3, forwardmost portion 60 of stack 56 comprising tape 62 has been separated from the flexible paperboard strip 64 which is shown being withdrawn between packet 54 and 56.

FIG. 4 illustrates banding 58(a) comprising flexible tape 62 joined to flexible paperboard strip 64 just subsequent to withdrawal between packets 54 and 56.

Referring now to FIGS. 1-4, dispenser 30 may be conveniently configured to adapt storage chute 59 to receive upwards of about 100 to about 150 items of cutlery, it will be appreciated that if cutlery is provided in banded packets of from about 30 to about 50 units per banded packet, dispenser 30 may be easily "topped off" when required or convenient, perhaps just before lunchtime or any other rush-hour for an establishment. Accordingly, wastefulness inherent in use of sealed cartridges of cutlery can be avoided as the banded packets can be sized to permit "topping off" when perhaps one third or one fourth of the capacity of dispenser 30 has been dispensed. Further, it can be appreciated that the cost of band 58 can be fairly minimal the band need only comprise a strip of flexible perhaps 150 pound per 3000 square-foot ream paperboard strip 64 of about, for example, 1 in. in width and about 10 in. in length joined to a similarly sized flexible tape 62, which will retain items of cutlery 32 within packet 56 in alignment during shipping, storage and insertion in dispenser 30.

Figure 5:
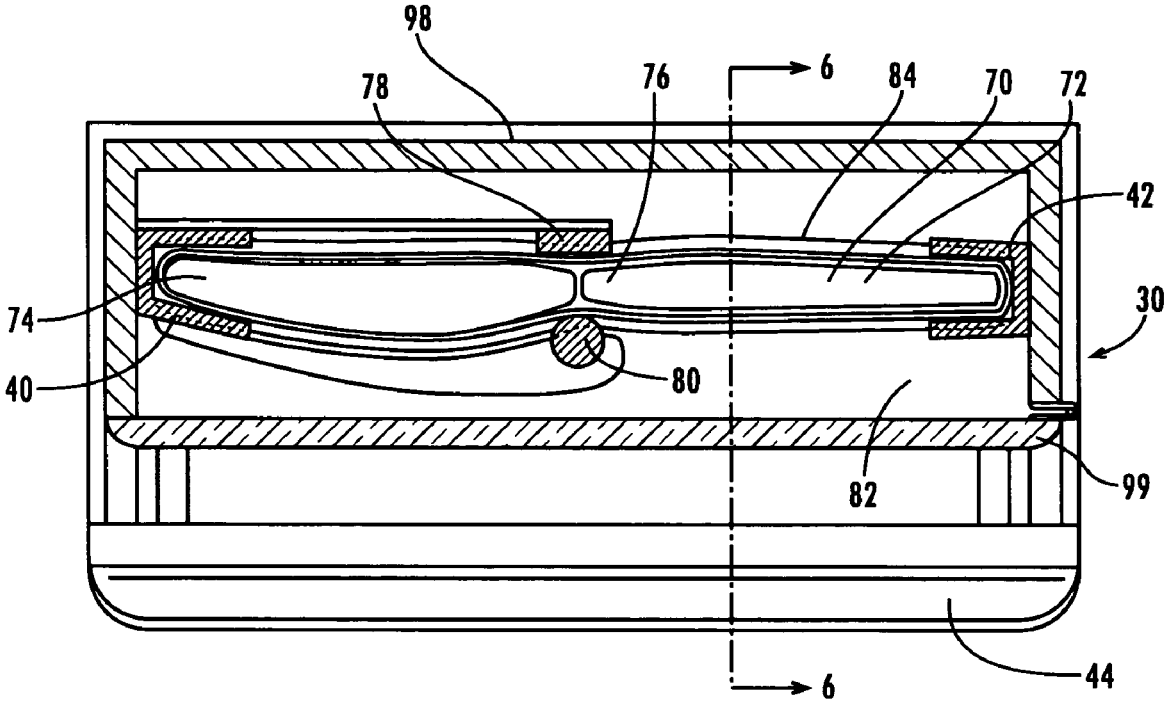
FIG. 5 is a top view of FIG. 4 illustrating a stack of cutlery retained in the dispenser of FIG. 1 after all of the banding has been removed from the individual packets.

In FIG. 5, which is a knife 70 comprising handle 72 and food contact portion 74 and joined thereto at neck 76 rests in storage chute 59 (not shown) of dispenser 30 with food contact portion 74 restrained in position by left guide channel 40 while handle 72 is retained in position by right guide channel 42. Central guides 78 and 80 adjacent to neck 76 further serve to retain knife 70 in position within the cutlery dispenser 30. Beneath knife 70, profile plate 82 having profile opening 84 conforming generally to a portion of the outline of knife 70 is visible. Front actuating handle 44 is located forwardly of a stack 68 (not shown) of knives 70. Profile opening 84 through profile plate 82 flares upwardly and outwardly from the level at which the second item of cutlery such as knife 70 will be when resting upon support shelf 100 (not shown).

Figure 6:
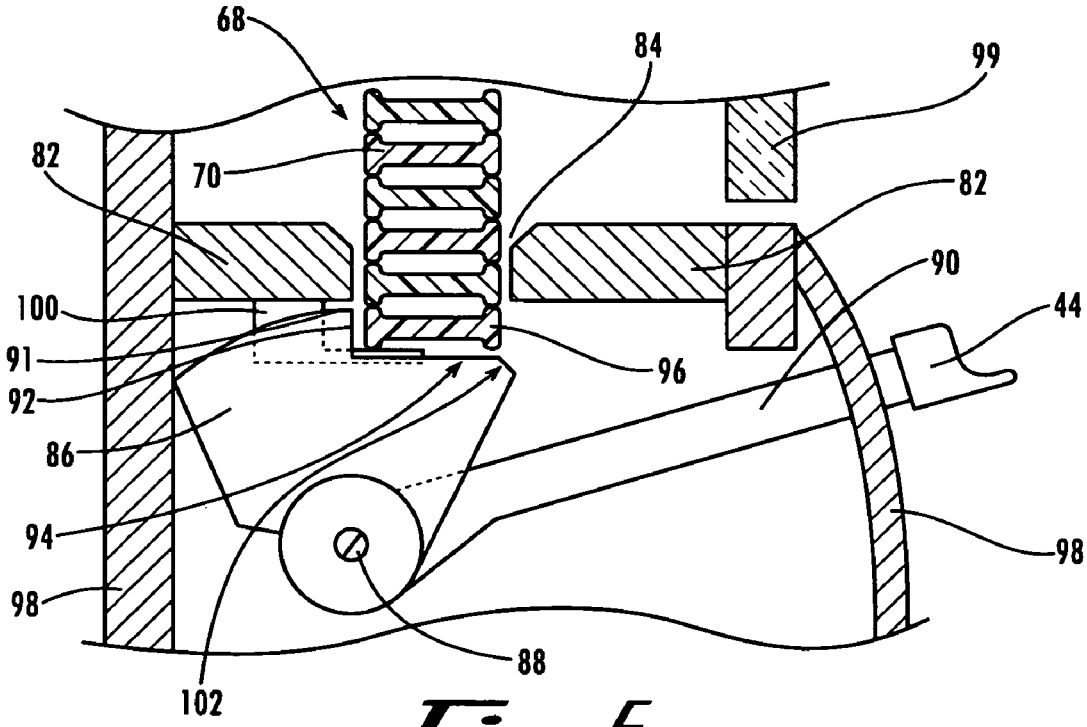
FIG. 6 is a sectional view along lines 6-6 in FIG. 5 illustrating schematically a stack of cutlery with the handle of one type of actuating mechanism in its rest position.

In FIG. 6, which is another example of the cutlery dispenser for knives 70 having a front actuating handle, rocking cam 86 is pivotally mounted upon rotatable shaft 88 having actuating arm 90 having actuating handle 44 attached thereto. Rocking cam 86 has lateral displacement surface 92 and clearance shelf 94 formed therein. The right-hand portion of lowermost knife 96 in stack 68 rests upon support shelf 100 positioned under profile plate 82 having profile opening 84 formed therethrough. Upper cam surface 103 provides lift as discussed later. The housing 98 encloses the other pictured elements. The door 99 encloses the stack 68.

Figure 7:
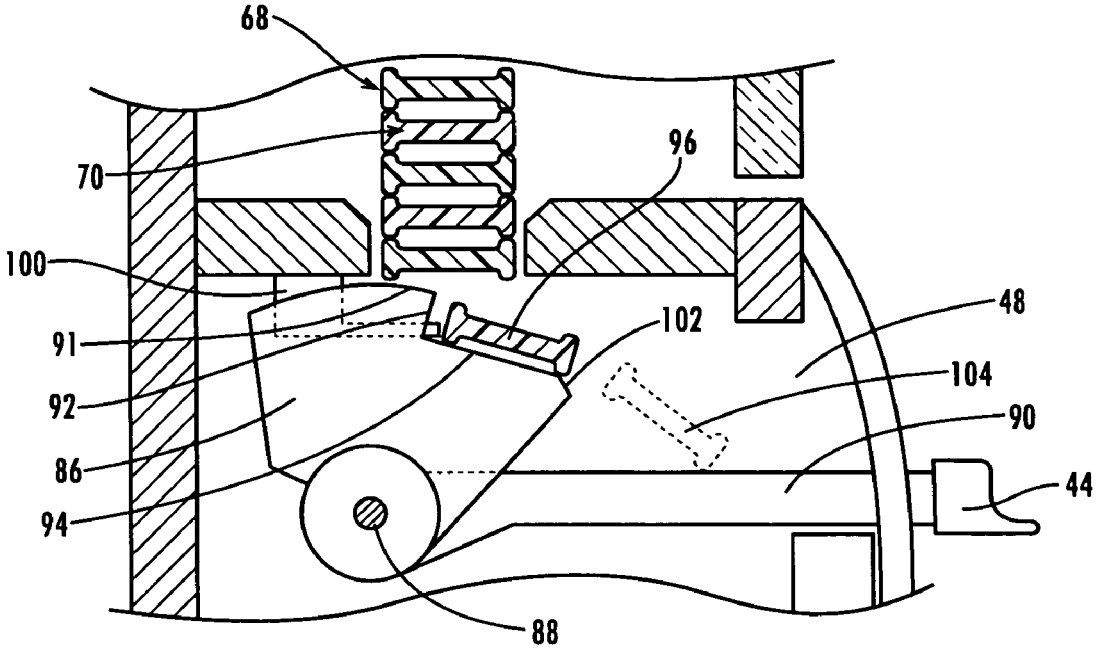
FIG. 7 is another sectional view corresponding to FIG. 6 after the handle of an actuating mechanism has been depressed illustrating the motion of the lowermost item of cutlery as it is dispensed.

Adjacent to clearance shelf 94, relief surface 102 facilitates motion of laterally displaced items of cutlery 104 through dispensing chute 48 as illustrated in FIG. 7. Rocking cam 86 has been moved clockwise by force transmitted to actuating arm 90 having actuating handle 44 attached thereto which has been depressed by the user (not shown) thereby laterally urging lowermost knife 96 forwardly off of support shelf 100 while clearance shelf 94 on rocking cam 86 retains stack 68 of knives 70 in position during lateral displacement of lowermost knife 96 in stack 68. Upon release of actuating handle 44 by user, rocking cam 86 rotates counterclockwise; and stack 68 of knives 70 drops into position, as shown in FIG. 6.

In many applications, it may be desirable to incorporate a rotary damper into the mounting mechanism for actuating handle 44 or rotatable shaft 88 so that, upon release, actuating handle 44 does not lurch act into its uppermost position. Such devices are well-known and are described in, inter alia, U.S. Published Application Nos.: 2004/0045398A1; 2003/0146061A1 and the following U.S. Pat. Nos. 6,840,353; 5,497,863; 5,542,508; 5,605,208; 5,660,252; 6,298,960; 5,460,252; 5,449,054; 5,413,317; 5,269,397; 5,211,267; 4,697,673; 4,691,811; 4,614,004; 4,574,423; and 4,571,773; the disclosures of which are each incorporated herein by reference.

Figure 8:
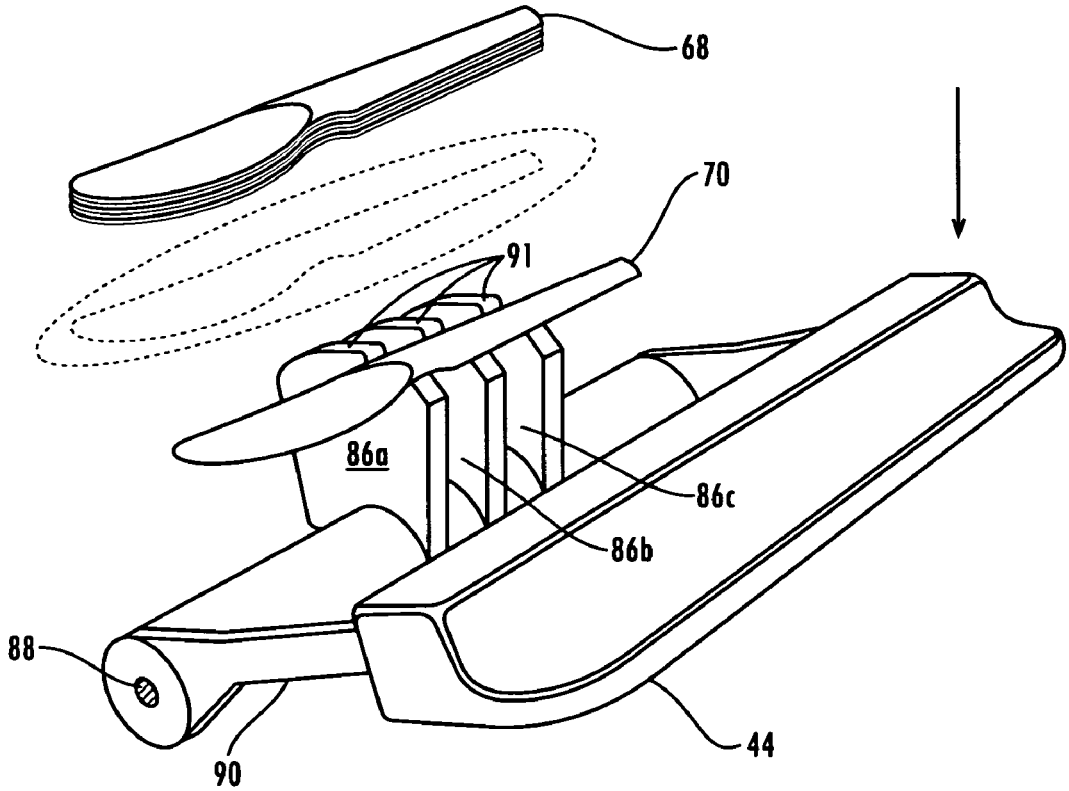
FIG. 8 is a schematic perspective illustrating the disposition of the first knife in a stack of cutlery relative to the rocking cams while resting on the support shelves (not shown) prior to depression of the handle of an actuating mechanism.
Figure 9:
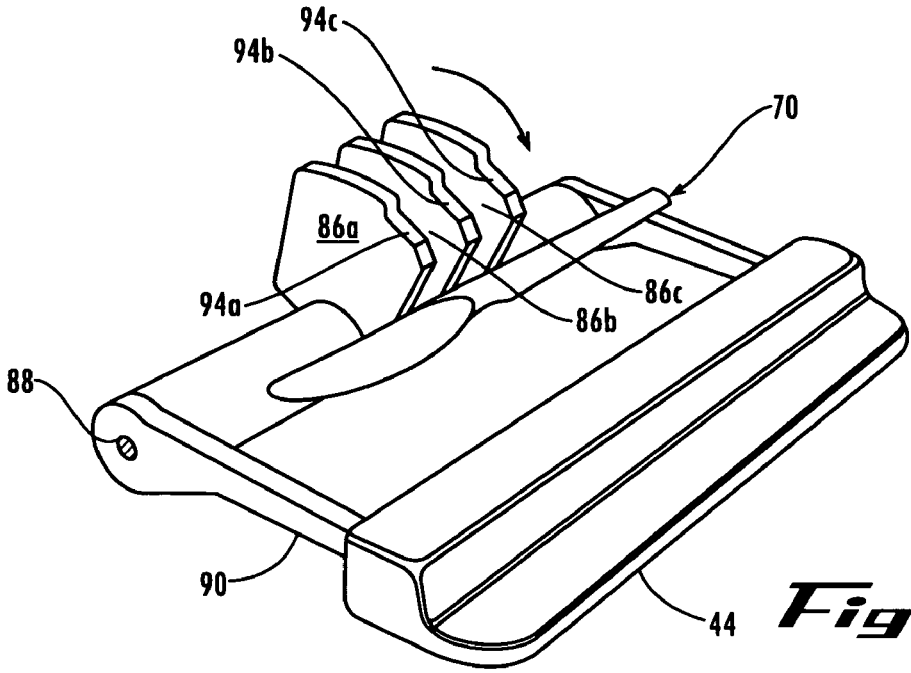
FIG. 9 is a schematic perspective illustrating motion of the lowermost knife in the stack of cutlery occurring on depression of the handle of an actuating mechanism.

FIGS. 8 and 9 show the dispensing motion of a front actuating handle 44. As shown in FIGS. 8 and 9, three rocking cams 86*a*, 86*b* and 86*c* can be configured on rotatable shaft 88. In use, knife 70 is positioned on rocking cams 86*a*, 86*b* and 86*c*, the knife sits in the respective positions in the rocking cams at clearance shelves 94A, 94*b* and 94*c*. Upon engagement of the actuating handle 44 by the user, the rocking cams 86*a*, 86*b* and 86*c* move in a forward (clockwise) direction to allow the knife 70 to be dispensed by the user.

Figure 10:
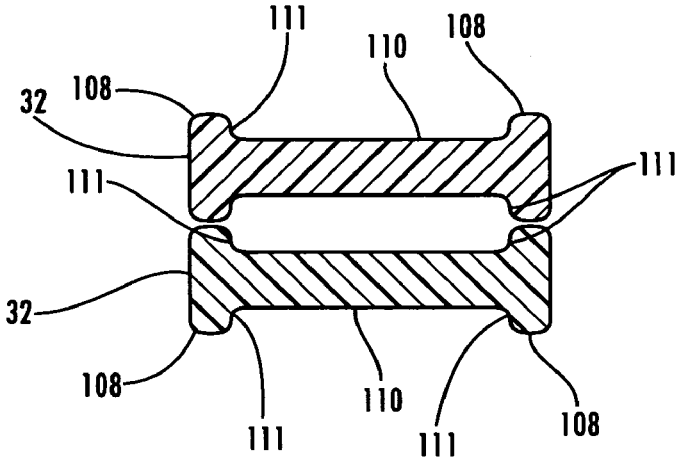
FIG. 10 illustrates a configuration of cutlery handles that accommodates suitable dispensing.

FIG. 10 illustrates a sectional view looking in the longitudinal direction of stacking for items of cutlery 32 in which ribs 108 surrounding central web 110 are each vertically aligned. Note that in FIG. 10, ribs 108 are joined to central web 110 in the medial portion of each rib so that there is a lip 111 both above and below central web 110.

Figure 11:
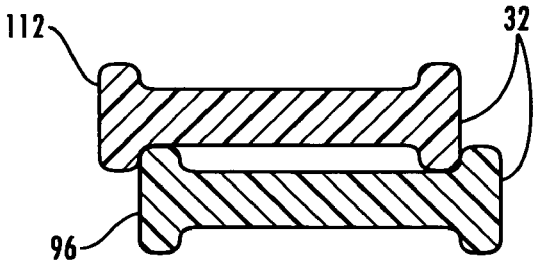
FIG. 11 illustrates a further configuration of cutlery handles that accommodates suitable dispensing.

In FIG. 11, the lowermost item of cutlery 96 is displaced forwardly of the second item of cutlery 112. If items of cutlery 32 in stack 36 become positioned in the configuration shown in FIG. 11 with first item of cutlery 96 displaced forwardly of second item cutlery 112, dispensing through rigid profile plate 82 (not shown) is not hindered.

Figure 12:
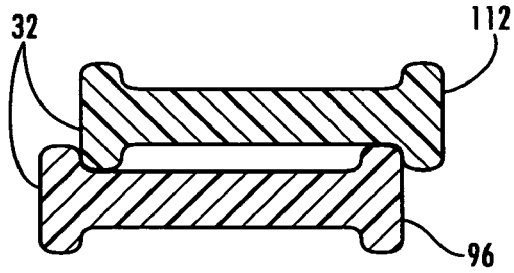
FIG. 12 illustrates a further configuration of cutlery handles that accommodates suitable dispensing.

FIG. 12 shows items of cutlery 32 where the items have become skewed such that the first item of cutlery 96 is being displaced rearwardly of the second item of cutlery 112.

Figure 13:
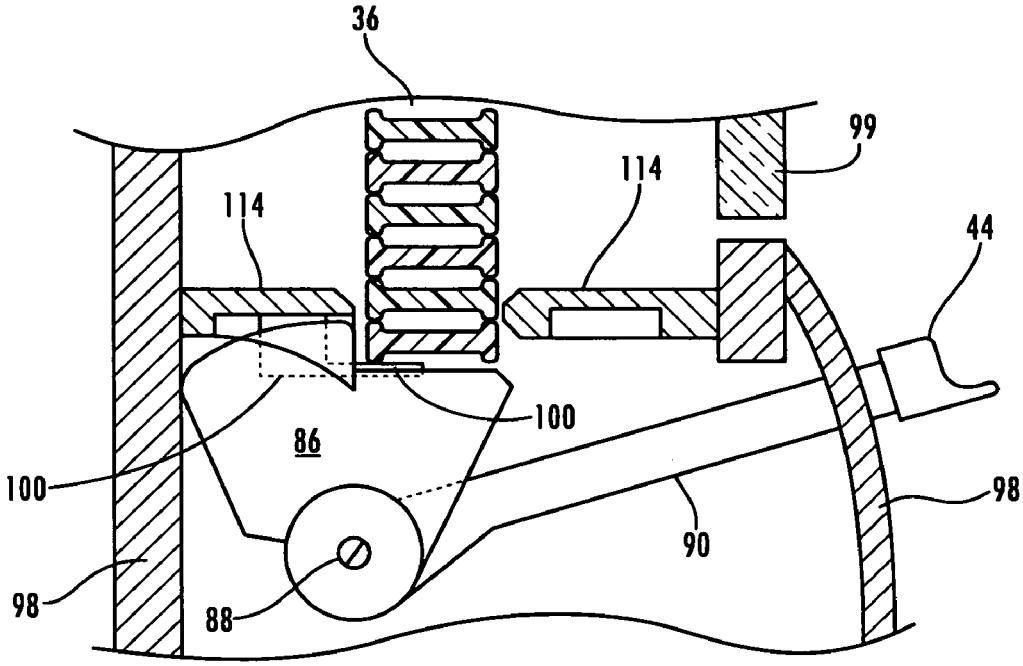
FIG. 13 is sectional view along lines 6-6 of FIG. 5 illustrating one configuration of a flexible dispensing plate.

FIGS. 13 illustrates a side view of the cutlery dispenser having the rocking cam configuration and a flexible profile plate 114. A stack 36 of cutlery is positioned on the support shelf 100 prior to pressing of actuating handle 44 by a user.

Figure 14:
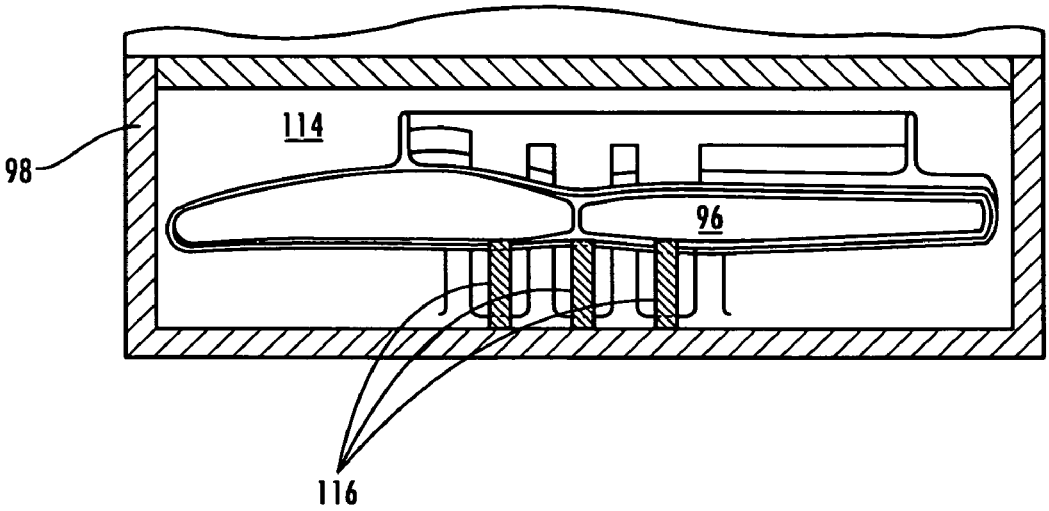
FIG. 14 is a bottom view of the flexible dispensing plate of FIG. 13 illustrating ribs formed into a flexible dispensing plate.

In FIG. 14, ribs 116 are formed in flexible profile plate 114 allowing respective rocking cams 86*a*, 86*b* and 86*c* to pass therebetween when actuating handle 44 (not shown) is depressed.

Figure 15:
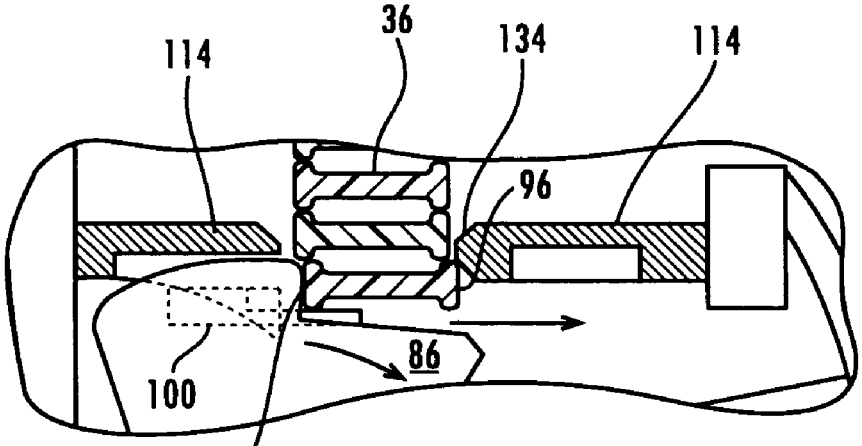
FIGS. 15, 16 and 17 are schematic sectional views illustrating movement of a cutlery piece using a rocking cam configuration.
Figure 16:
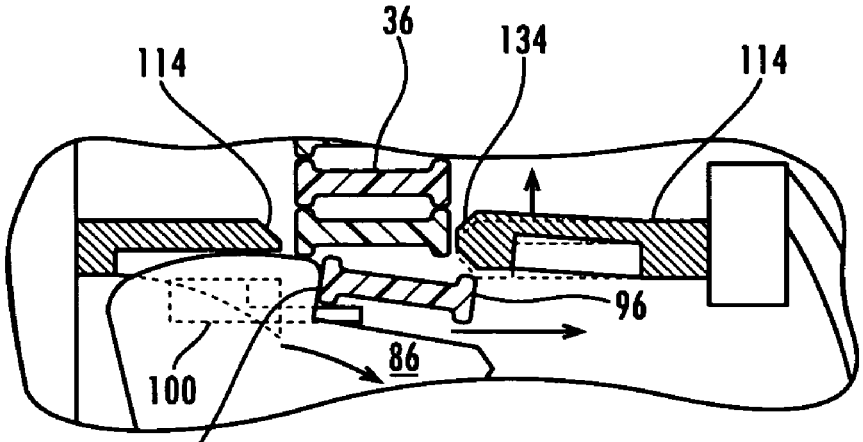
Figure 17:
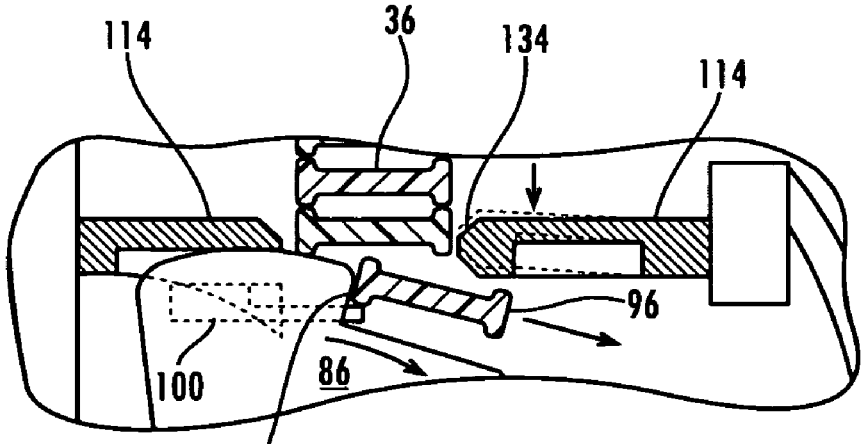

As illustrated in FIGS. 15, 16 and 17, when actuating handle 44 is depressed, rocking cam 86 is rotated clockwise forcing lowermost item of cutlery 96 against yieldable surface 134 of flexible profile plate 114 which displaces upwardly as shown in FIG. 16 as lowermost item of cutlery 96 is forced forwardly by lateral displacement surface 92 of rocking cam 86. Substantially simultaneously, lateral displacement surface 92 of rocking cam 86 urges stack of cutlery 36 upwardly. As illustrated in FIG. 17, as lowermost item of cutlery 96 moves forwardly of yieldable surface 134 of flexible profile plate 114 returns to position with stack of cutlery falling into position upon release of actuating handle 44 and return of rocking cam 86 counterclockwise to its home position with stack of cutlery 36 resting on support shelf 100.

Figure 18:
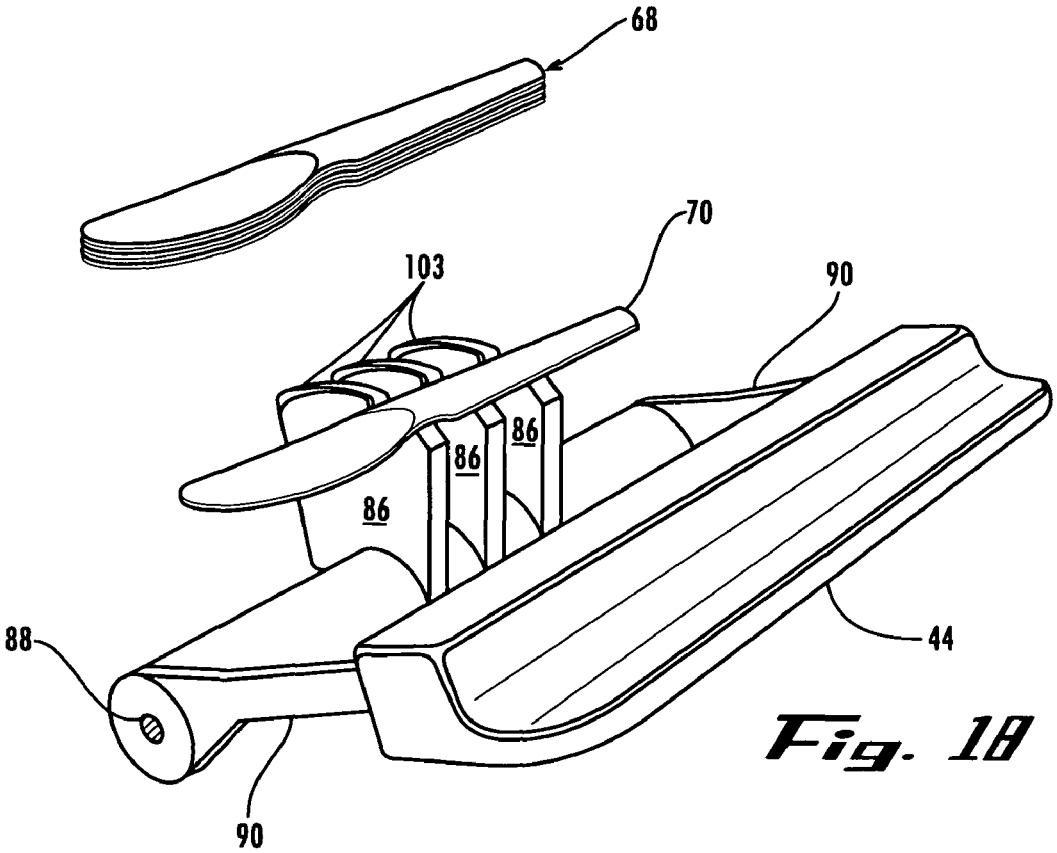
FIGS. 18 and 19 are views further illustrating features of the rocking cam configuration of FIGS. 15, 16 and 17.

FIGS. 18 and 19 illustrate a rocking cam 86 in which upper cam surface 103 are configured with increased lift as illustrated in FIG. 19 by shaded area 103*v* in which the radius to lifting surface 103*v* from rotatable shaft 88 increases with the rearward distance from lateral displacement surface 92 such that stack 68 of knives 70 is lifted upwardly upon actuation of actuating arm 90 as a lowermost knife 70 is dispensed. Upon release of actuating arm 90, stack 68 of knives 70 drops into position on clearance shelf 94. For example, the inventors herein have found that use of about one eighth inch of lift can aid in jostling knives 70 in stack 68 into better alignment and can assist in efficient dispensing. This efficient dispensing is also seen with other types of cutlery.

The inventors herein have found that front actuating handle dispensers of one form of the present invention with rigid profile plates 82 and rocking cams 86 as illustrated in FIGS. 6, 7, 8 and 9 can be made to exhibit minimal incidence of jamming and hard dispensing (perhaps around 2 per 1000 dispenses). Examples of the present invention incorporating flexible profile plate 114 and rocking cam 86 as illustrated in FIGS. 13 through 19 will exhibit hard dispensing or jamming so infrequently that it becomes difficult to measure with knives and forks and only slightly more frequently with spoons which are more difficult to dispense because of the strong curvature and ridging that can be found in the neck region of conventional disposable spoons. Even with spoons, the embodiments incorporating the combination of flexible profile plate 114, offset rocking cams 86*a*, 86*b* and 86*c* can provide a high degree of dispensing reliability. (As noted, the profile plate, whether flexible or otherwise, may not be needed when the flexible retention rail 156 (not shown) is used.)

Figure 20:
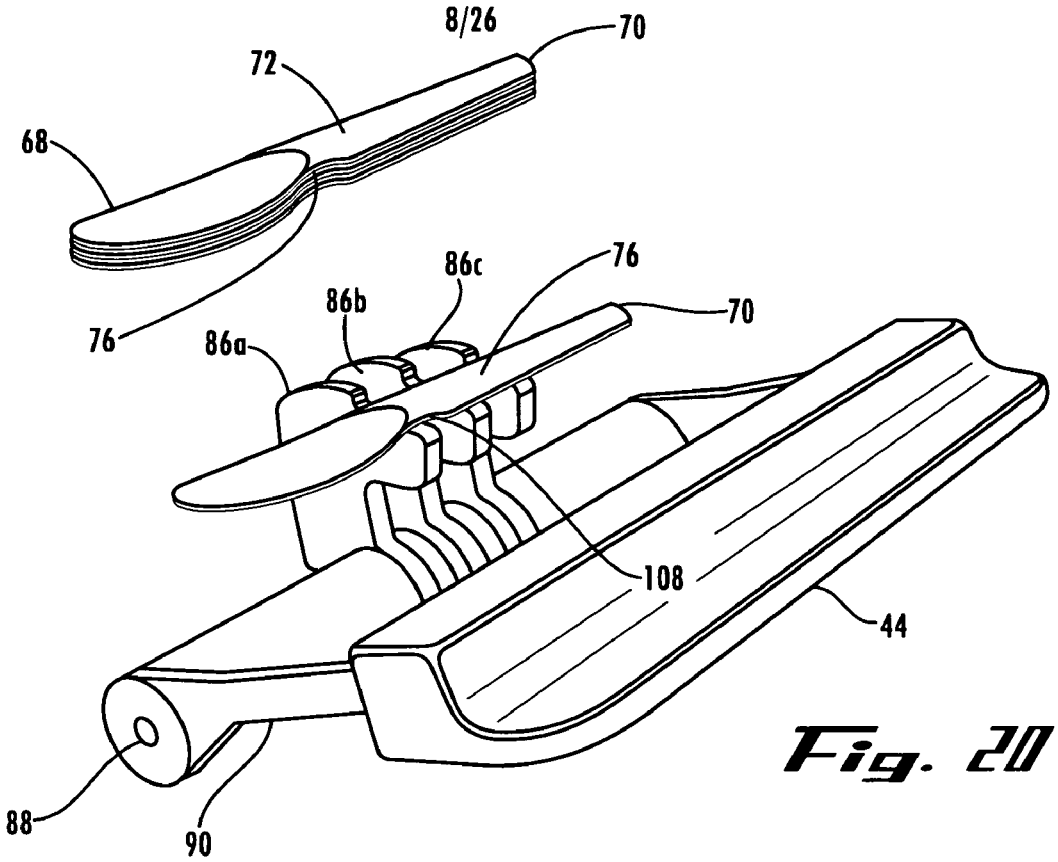
FIGS. 20 and 21 illustrate a rocking cam geometry to suitably lever the handle out of the stack.
Figure 21:
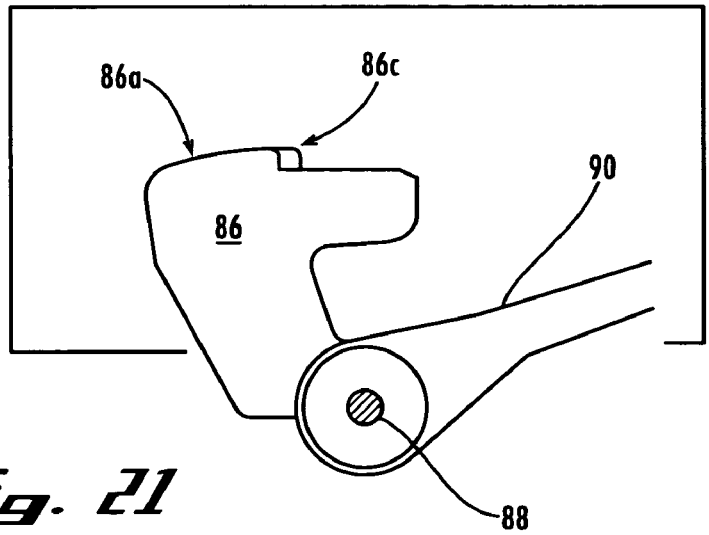

FIGS. 20 and 21 illustrate an offset cam which is particularly suitable for difficult-to-dispense items of cutlery, such as knives 70 in stack 68, particularly those having very pronounced ribs 108 (not shown) in neck region 76. As illustrated in FIGS. 20 and 21, the rocking cam mechanism comprises three individual rocking cams 86*a*, 86*b*, and 86*c* with lateral displacement surfaces 92*a*, 92*b* and 92*c* respectively (not shown). In FIG. 20, right most cam plate 86*c* is located slightly forwardly of displacement surfaces 92*a* and 92*b* (not shown) on cam plates and 86*a* and 86*b*. This arrangement makes it possible to urge handle 72 of item of knife 70 forwardly prior to attempting to dislodge ribs 108 (not shown) in neck portion 76 from engagement with each other. In the case of spoons, it has been found that use of offset cam plates 86*a*, 86*b* and 86*c*, can materially aid dispensing, particularly when right guide channel 42 (not shown) is removed in the cutlery dispenser. FIG. 21 shows a side view of the offset cam structure, where right most cam 86*c* is visible because it is slightly offset from the other cams 86*a* and 86*b* (not shown).

Figure 22:
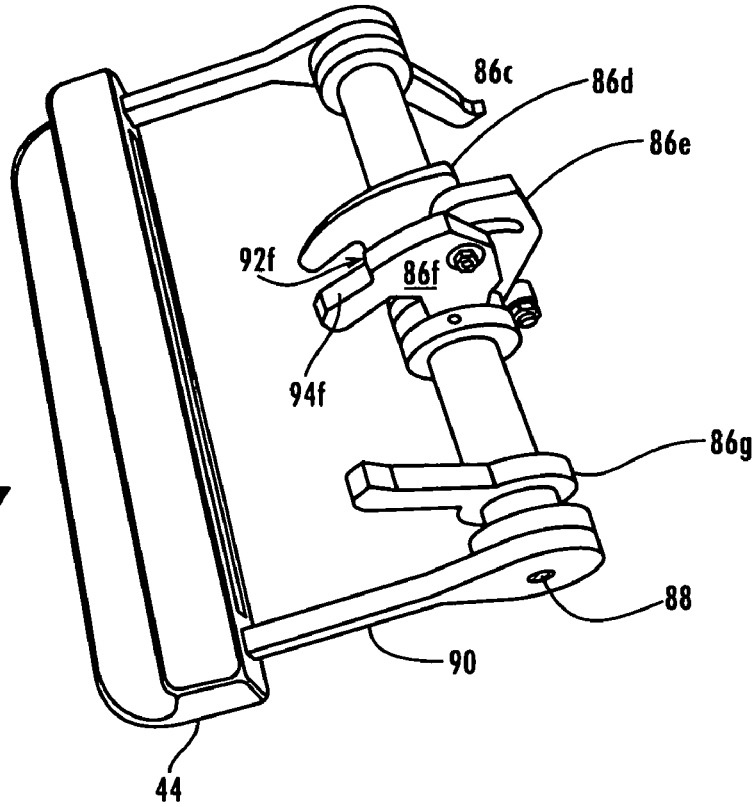
FIGS. 22 and 23 illustrate a rocking cam having a handle alignment arm.
Figure 23:
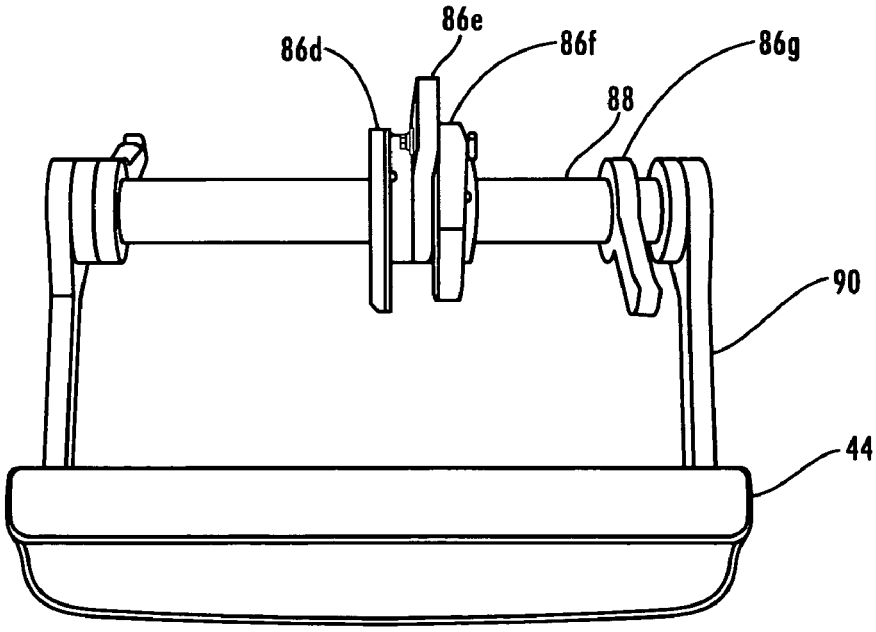

FIGS. 22 and 23 illustrate a cam having a handle alignment arm thereupon for correcting angular alignment of items of cutlery in the stack. In FIG. 22, actuating handle 44 is connected to actuating arm 90 joined to rotatable shaft 88 with forward cam plate 86*d* being disposed to support an item of cutlery resting upon it and clearance shelf 94*f* on rear cam plate 86*f*. Upon actuation, the dispenser operates in the usual manner with rotatable shaft 88 rotating counterclockwise so that lateral displacement surface 92*f* on cam plate 86*f* urges an item of cutlery resting thereupon laterally for dispensing. When actuating handle 44 is released, rotatable shaft 88 pivots clockwise upon urging of retraction spring (not shown) connected to return lever 86*g* on rotatable shaft 88 with clockwise motion thereof being arrested by stop cam 86*e* shown here disposed between cam plates 86*d* and 86*f*. It has been observed that, in many cases, the handle portion of the third item of cutlery will become forwardly displaced upon dispensing on the nethermost item of cutlery and that this can sometimes interfere with efficient dispensing thereof. As rotatable shaft 88 rotates clockwise, handle alignment arm 86*g* bears against any item of cutlery having its handle forwardly displaced and returns it to its proper alignment.

Figure 24:
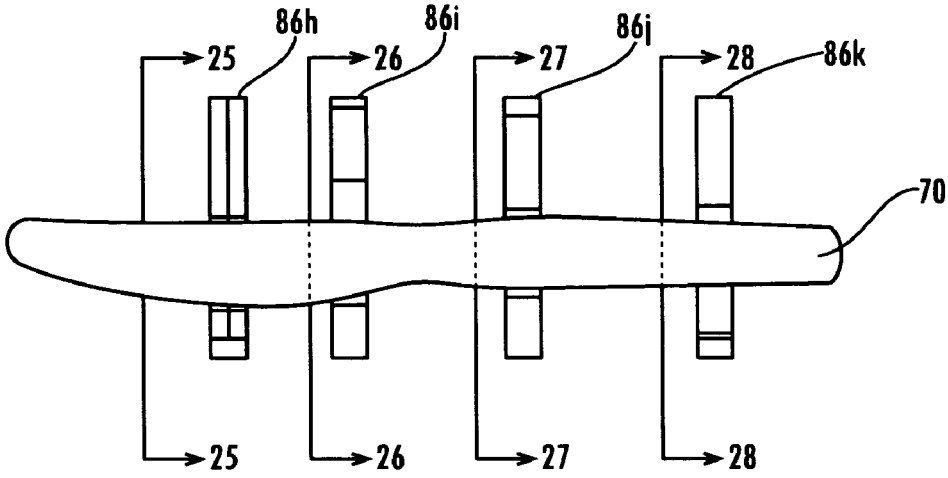
FIGS. 24, 25, 26, 27 and 28 illustrate the rocking cam shapes and disposition of the rocking cam plates on a cam having a handle alignment arm.
Figure 25:
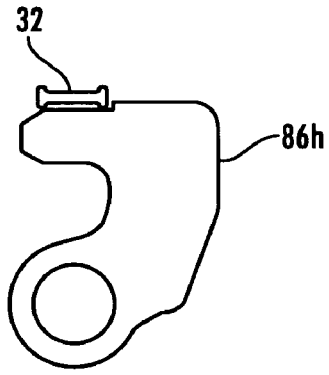
Figure 26:
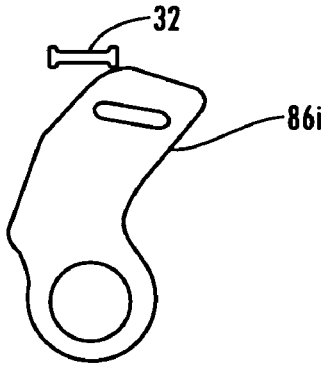
Figure 27:
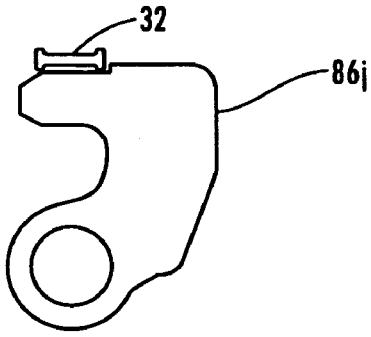
Figure 28:
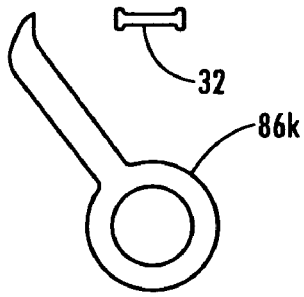

FIGS. 24, 25, 26, 27 and 28 illustrate the cam shapes (86*i*, 861*m*, 86*j* and 86*k*) suitable for correcting angular alignment of knives 70 in the stack 68 (not shown). In FIG. 24, the notations 25, 26, 27 and 28 indicate the respective cam shape that is at that location on the rotatable shaft 88 (not shown). These cam shapes are also suitable for correcting the alignment of other types of cutlery.

Figure 29:
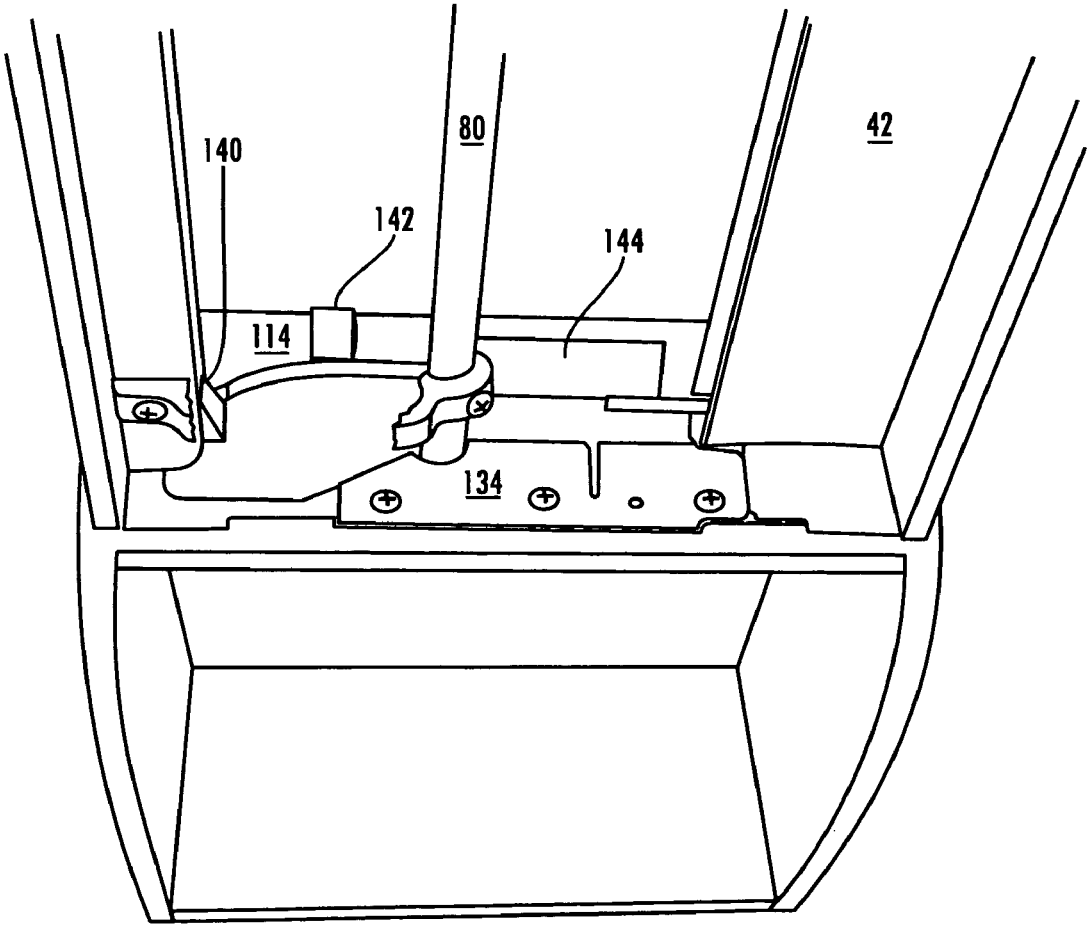
FIG. 29 is a perspective illustrating the inter-relationship between the rocking cam surfaces, support shelves, contour plate and guide features above the contour plate in one form of the present invention.

FIG. 29 is a perspective view illustrating the inter-relationship between the cam surfaces, support shelves, contour plate and guide features above the contour plate in one example of the present invention in which leftmost guide ramp 140 serves to longitudinally position the item of cutlery (not shown) while left rear diagram 142 guides food contact portion 74 (not shown) into position in right rear diagram 144 urges handle portion 72 (not shown) into proper position for dispensing. Central guide 80 serves to restrain items of cutlery 32 (not shown) above the topmost item of cutlery (not shown) from forward displacement in the region of neck 76 (not shown).

Figure 30:
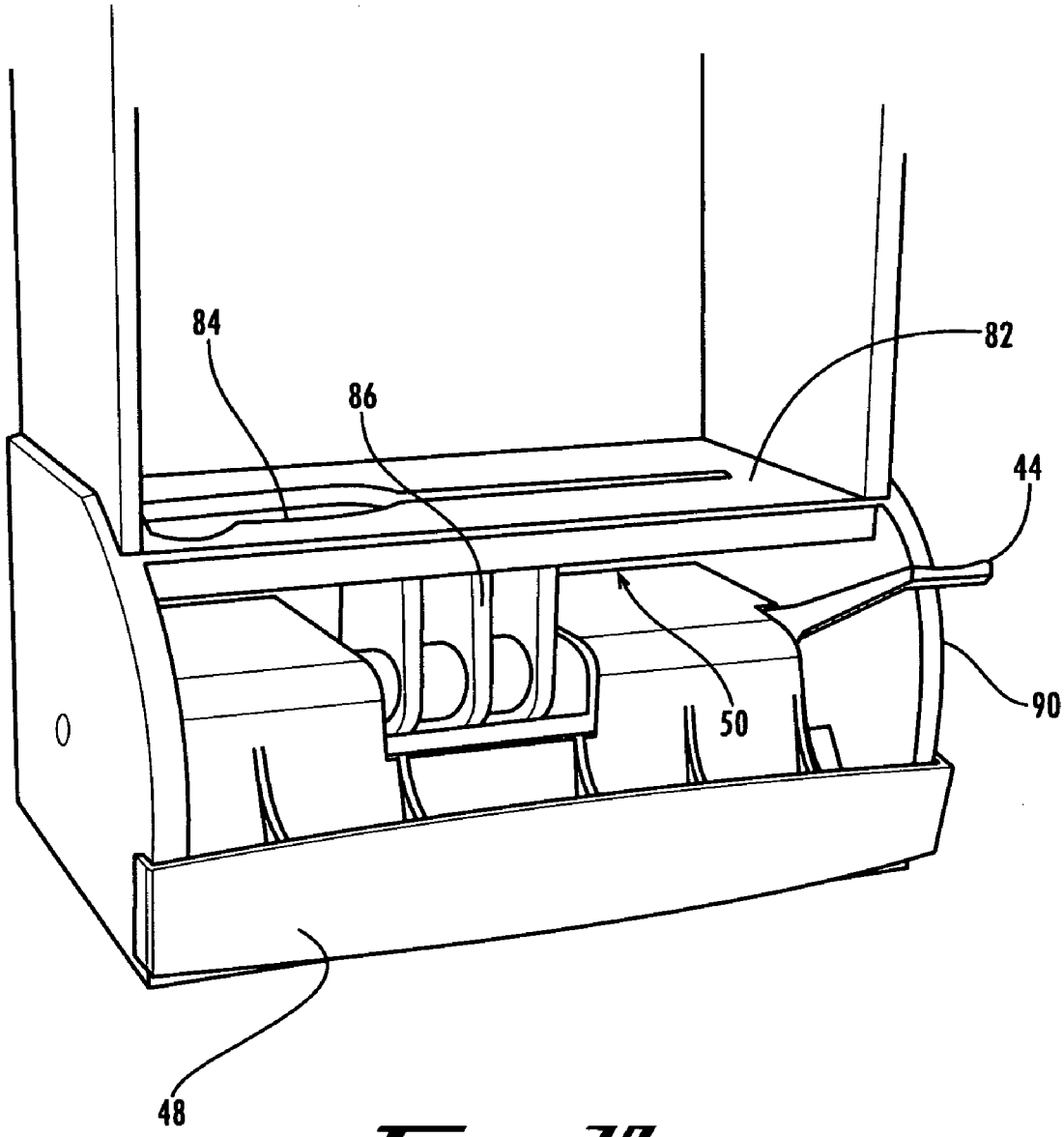
FIG. 30 illustrates a lower portion of a reduced height example of the dispenser of the present invention.

FIG. 30 illustrates the lower portion of a reduced height embodiment of the dispenser of the present invention in which profile plate 82 having profile opening 84 therethrough is disposed above kick-out mechanism 86 connected via rotatable shaft 88 (not shown) to actuating arm 90 having actuating handle 44 which rather than extending in front of dispensing opening 50 is displaced rightwardly therefrom so that access to dispensing chute 48 is not impeded thereby.

Figure 31:
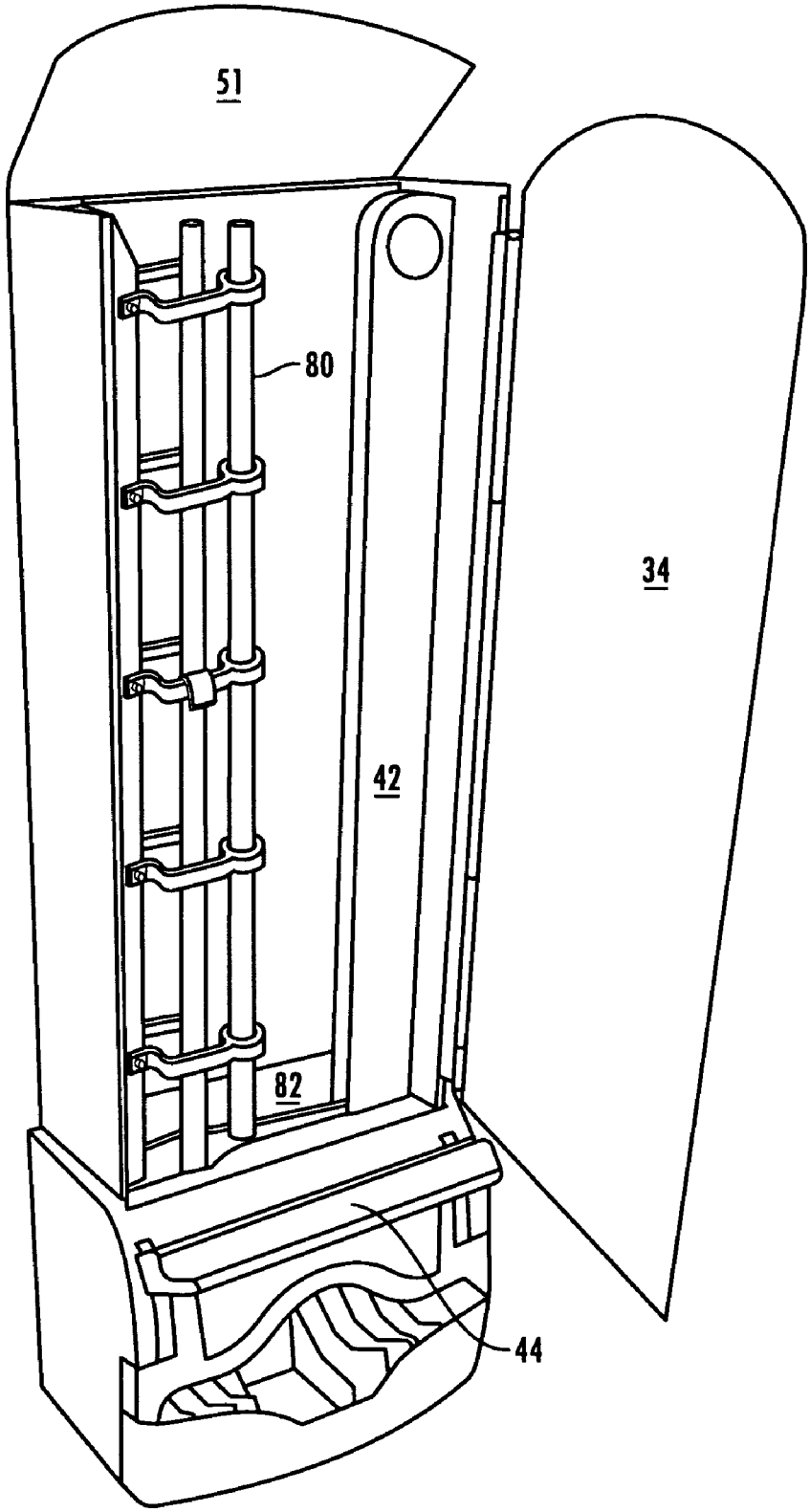
FIG. 31 is a perspective illustrating the overall configuration of one example of an empty cutlery dispenser of the present invention.

FIG. 31 is a perspective illustrating the overall configuration of one example of an empty cutlery dispenser of the present invention in which the left guide channel has been omitted because it has been found that it can be difficult in some circumstances to attempt to confine bowls of spoons too closely. Otherwise the configuration operation of the dispenser of FIG. 31 is comparable to the previously described dispensers.

Figure 32:
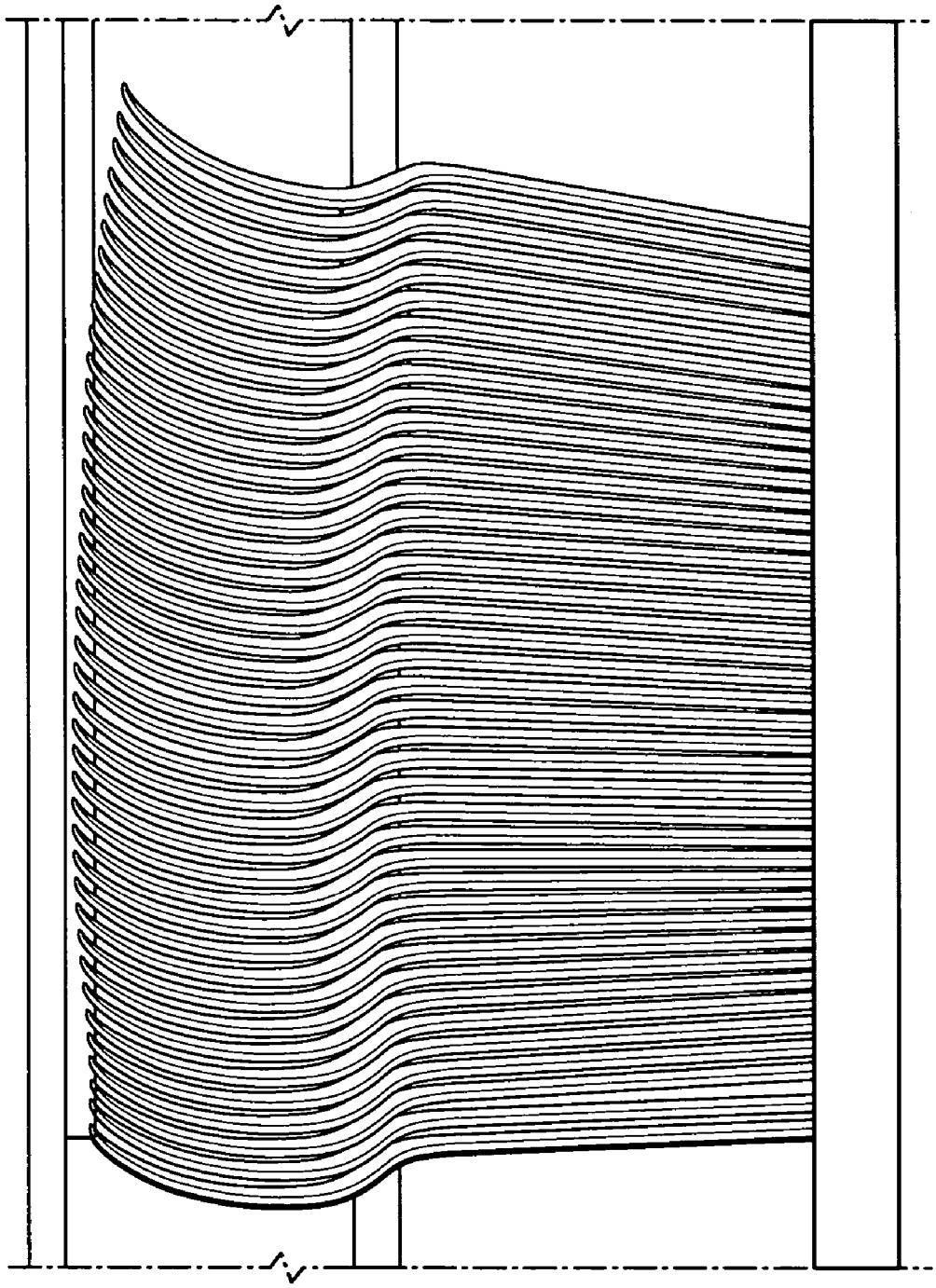
FIG. 32 illustrates how a stack of conventional spoons assumes a "fanned" aspect.

FIG. 32 illustrates how a stack of conventional spoons assumes a "fanned" aspect which the inventors herein have found can greatly interfere with efficient dispensing.

Figure 33:
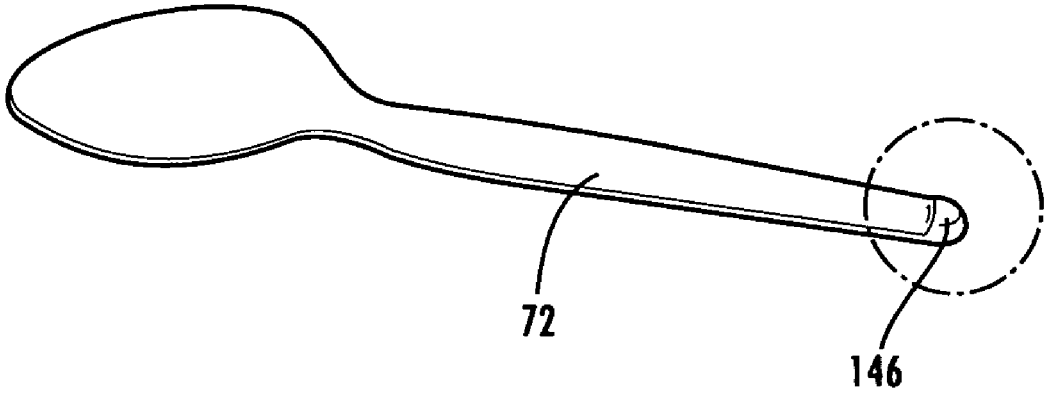
FIGS. 33 and 34 illustrates a spoon having a leveling promontory thereupon to reduce the tendency of a stack of spoons to assume a "fanned" aspect.
Figure 34:
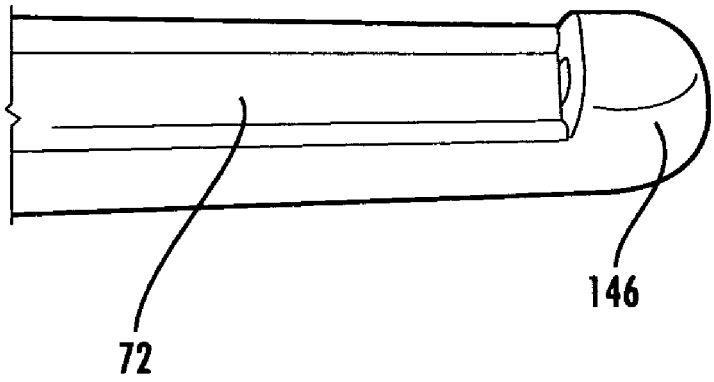

FIGS. 33 and 34 illustrate a spoon having leveling promontory 146 on handle 72 thereof to reduce the tendency of a stack of spoons to assume a "fanned" aspect. As illustrated in FIGS. 33 and 34, leveling promontory 146 is located upon the terminal portion of handle 72 and is generally frusto-spheroidal in shape in this case taking the aspect of roughly one quarter of a spheroid with the section planes defining the frusto-spheroid being located forwardly and against the handle. In other cases, hemi-spheroidal leveling promontories can be advantageous, the goal being to avoid portions of surfaces having tendency to interlock and/or resist slipping past similar surfaces.

Figure 35:
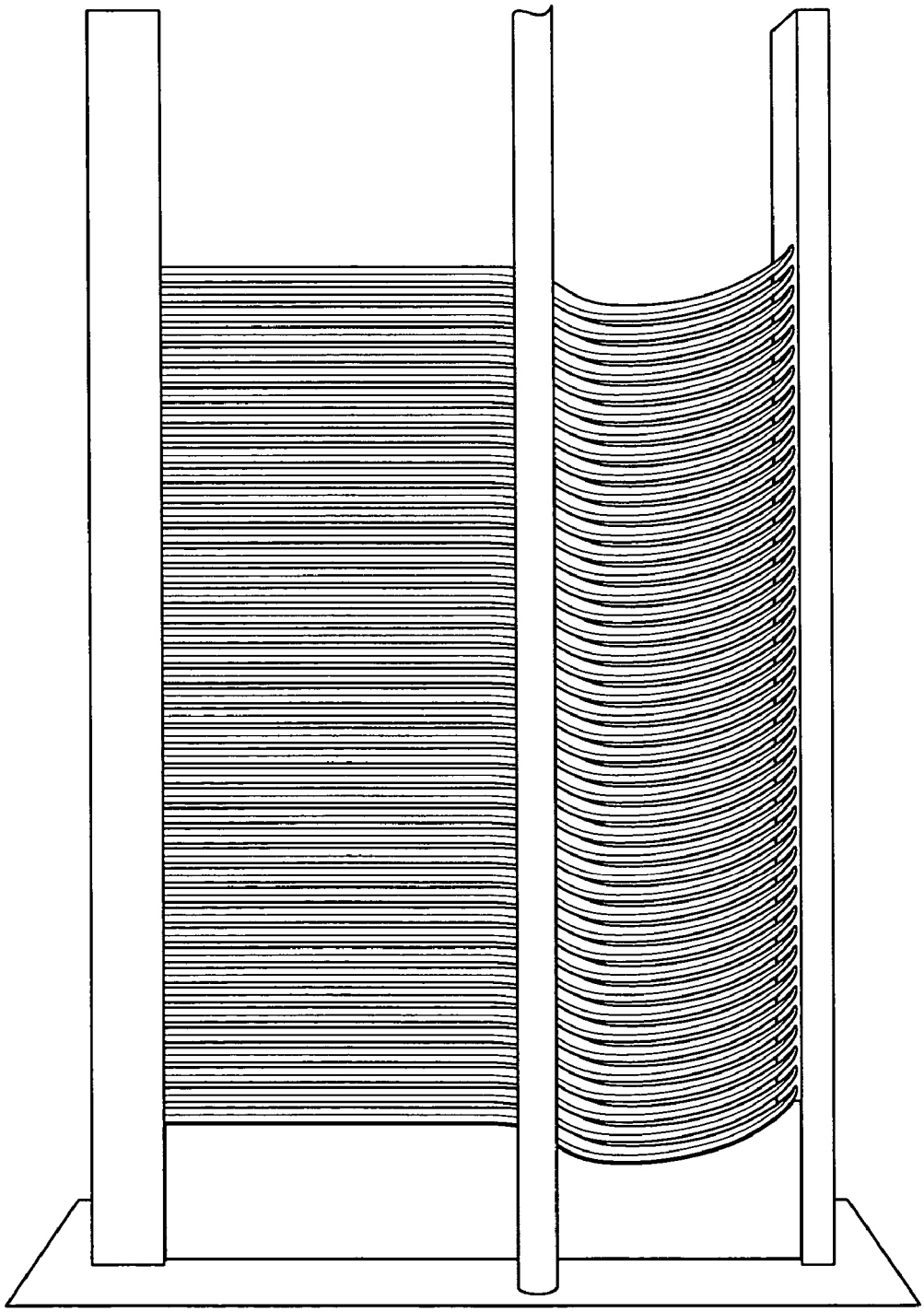
FIG. 35 illustrates the stacking of spoons having leveling promontories thereupon.
Figure 36A:
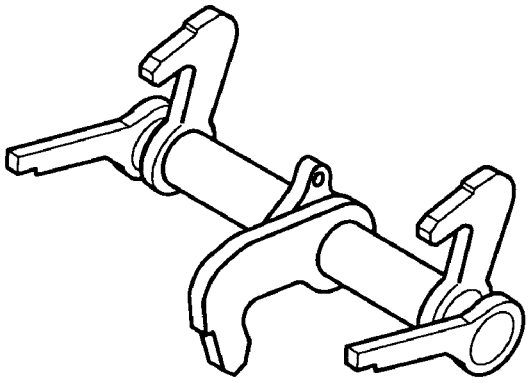
FIGS. 36*a*, 36*b*, 36*c* and 36*d* illustrate the kick-out rocking cam.
Figure 36B:
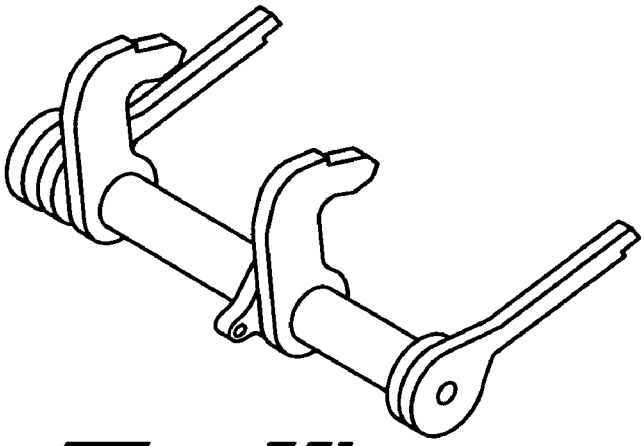
Figure 36C:
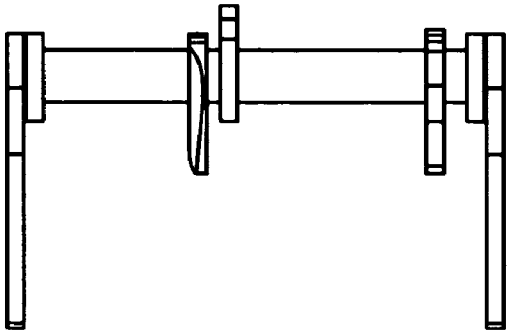
Figure 36D:
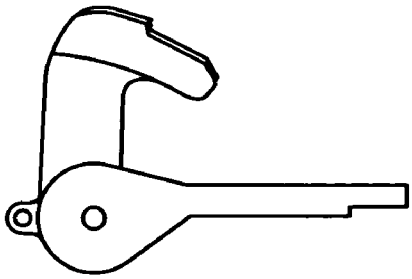
Figure 31A:
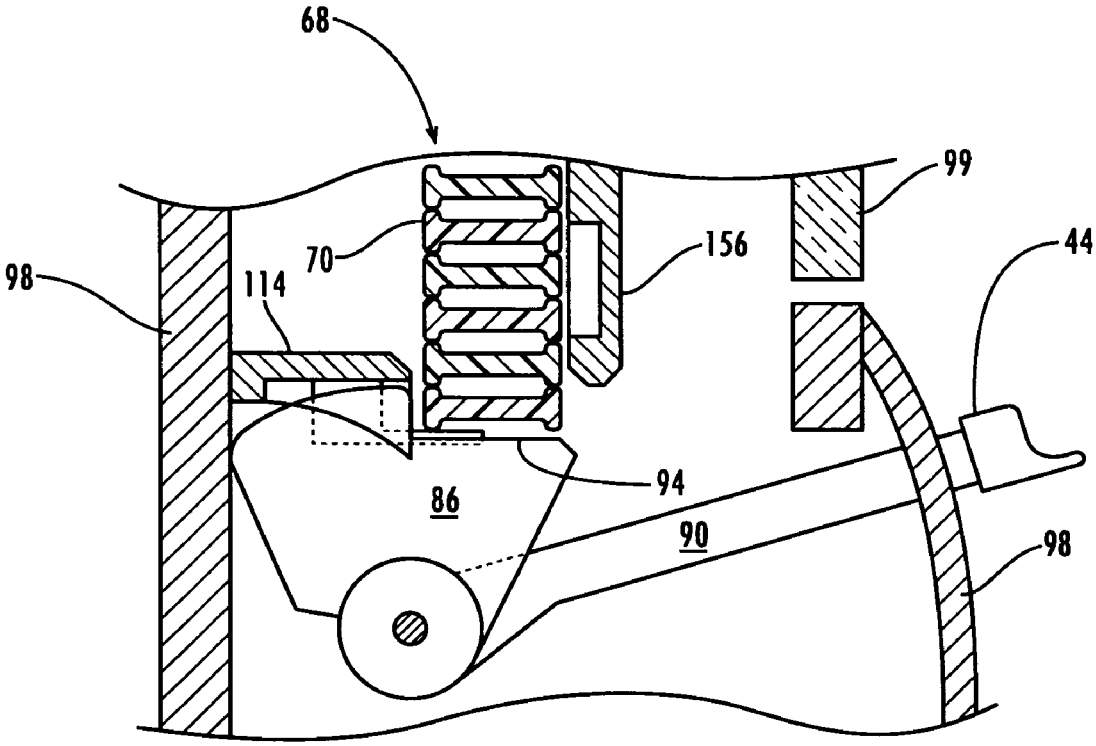

FIG. 35 illustrates the stacking of spoons having leveling promotories thereupon (not shown) in which it can be readily seen that the undesirable tendency to fanning has been greatly alleviated. It has been found that spoons having leveling promotories that reduce fanning can be easier to dispense than spoons subject to fanning.

Figure 37B:
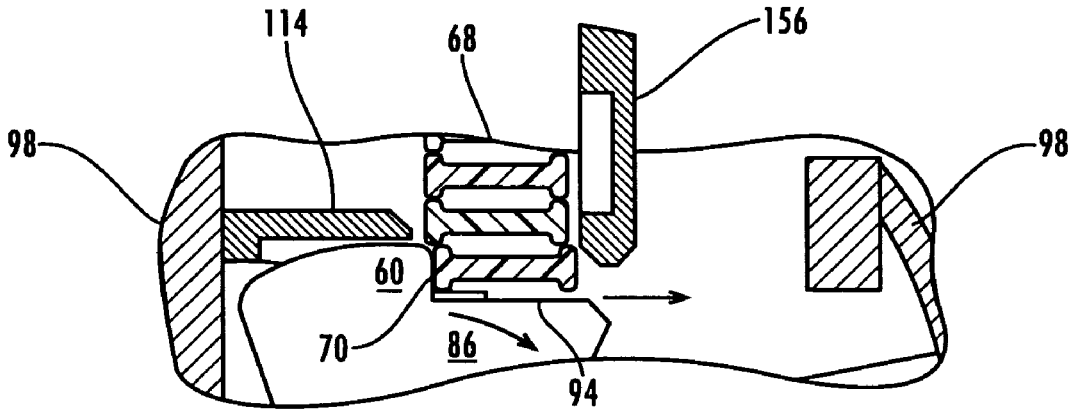
FIGS. 37*b*, 37*c* and 37*d* illustrates operation of the dispenser of FIG. 37*a*.
Figure 37C:
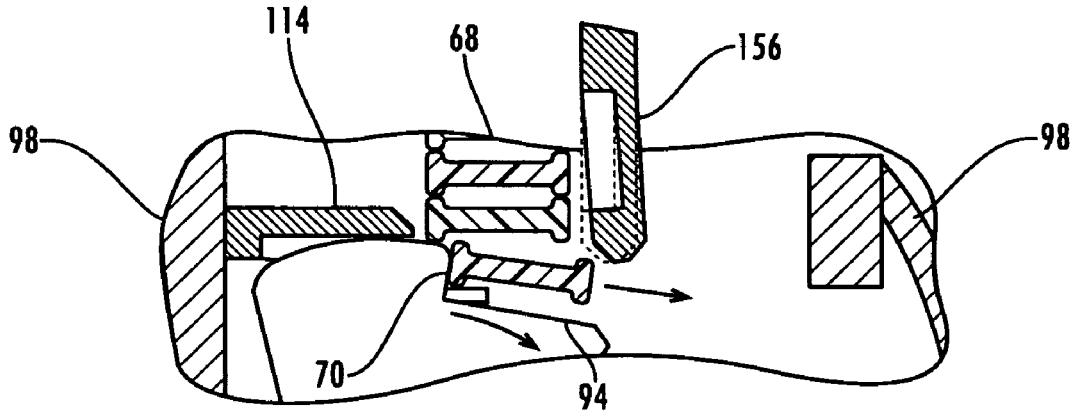
Figure 37D:
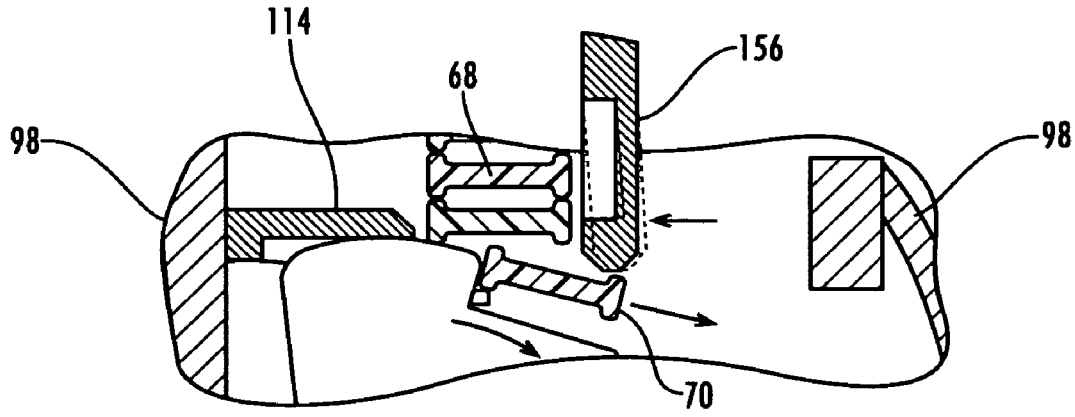
Figure 3H:
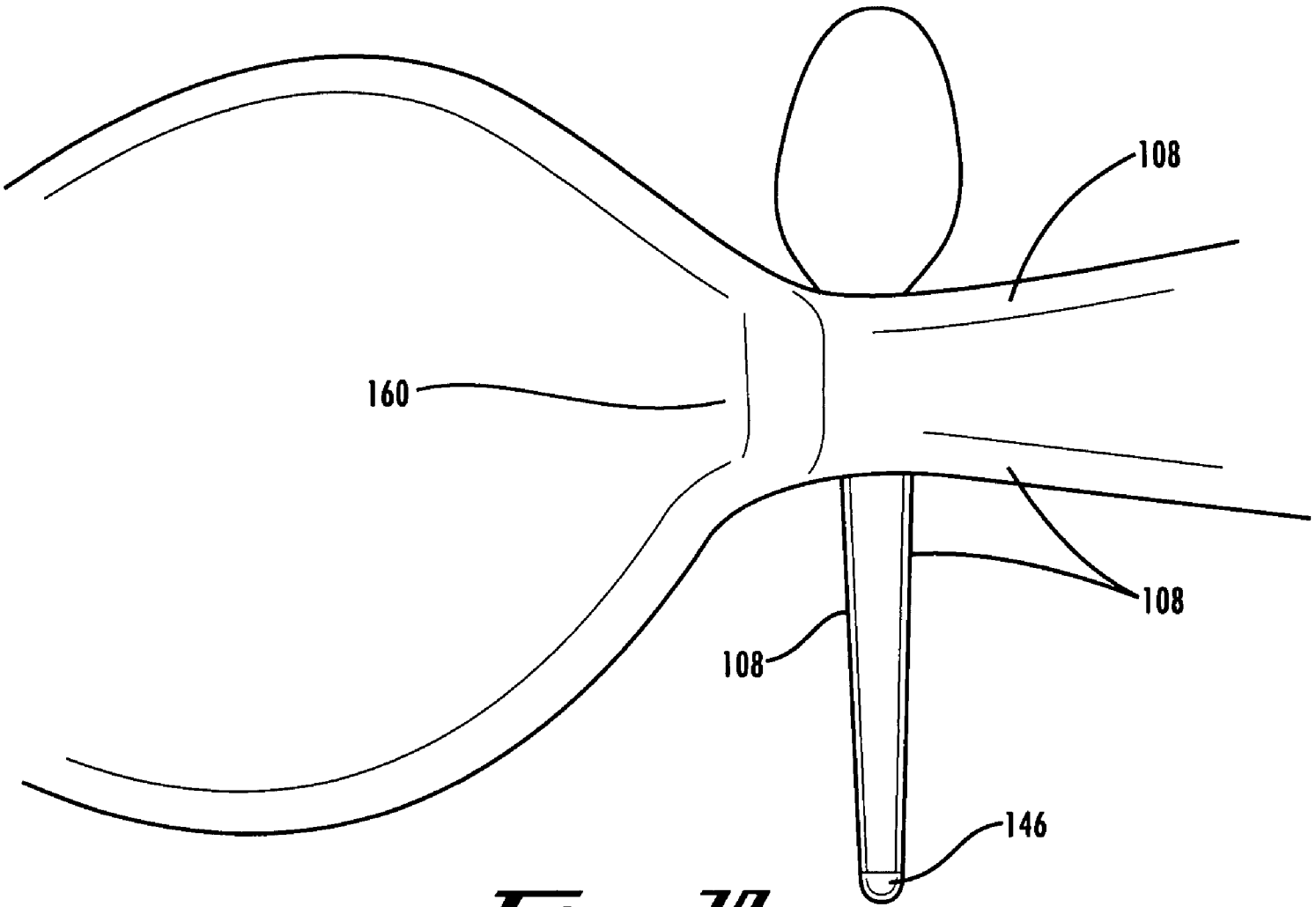

In some cases it is possible to eliminate all or part of flexible profile plate 114 from the cutlery dispenser when rocking cams such as those illustrated in FIGS. 36*a*, 36*b*, 36*c* and 36*d* are used with a flexible profile plate 114. FIGS. 37*a*, 37*b*, 37*c* and 37*d* show operation of a cutlery dispenser that includes a flexible vertical retention rail 156. Although part of flexible retention rail 114 is shown in FIG. 37*a*, it has been found that, in some circumstances, optimal operation of the cutlery dispenser is found when flexible retention rail 156 is used without the flexible profile plate 114. The flexible retention rail 156 is moved forward slightly as the rocking cam moves the knife 70 forward. This forward motion allows the knife 70 to be dispensed. Upon forward motion of the knife 70, the flexible retention rail 156 moves backward to a resting (or home) position.

FIG. 38 illustrates spanning crossbar 160 inserted between ribs 108 on the backside of neck 76 of a spoon to reduce interlocking between a rib on an adjacent spoon. In spoons provided with leveling promontory 146, presence of crossbar 160 appears not to materially affect the already excellent dispensing reliability but does greatly improve the smoothness and ease of dispensing.

Figure 39:
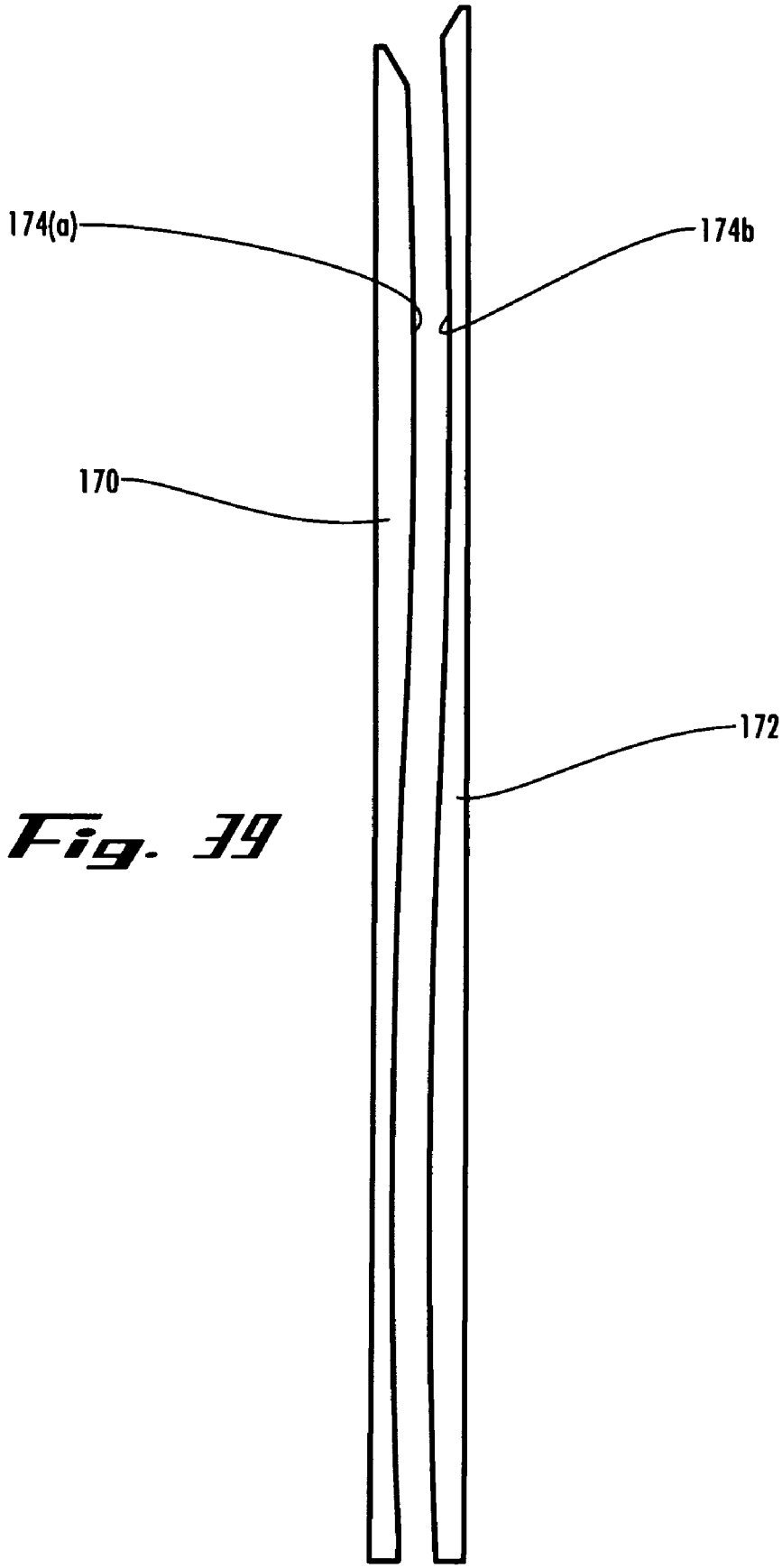
FIG. 39 illustrates a curved version of the vertical guide rails.

Referring now to FIG. 39, in which the front 200 and 202 for a fork stack (not shown) and back guide surfaces 170 and 172 for a fork stack (not shown) have matched arched surfaces 174*a* and 174*b* that guide the individual forks (not shown) forward and rearward as the stack of cutlery (not shown) is gravity fed toward the bottom of the storage chute (not shown), and aid in jostling items of cutlery into better alignment and materially aides in dispensing.

Figure 40:
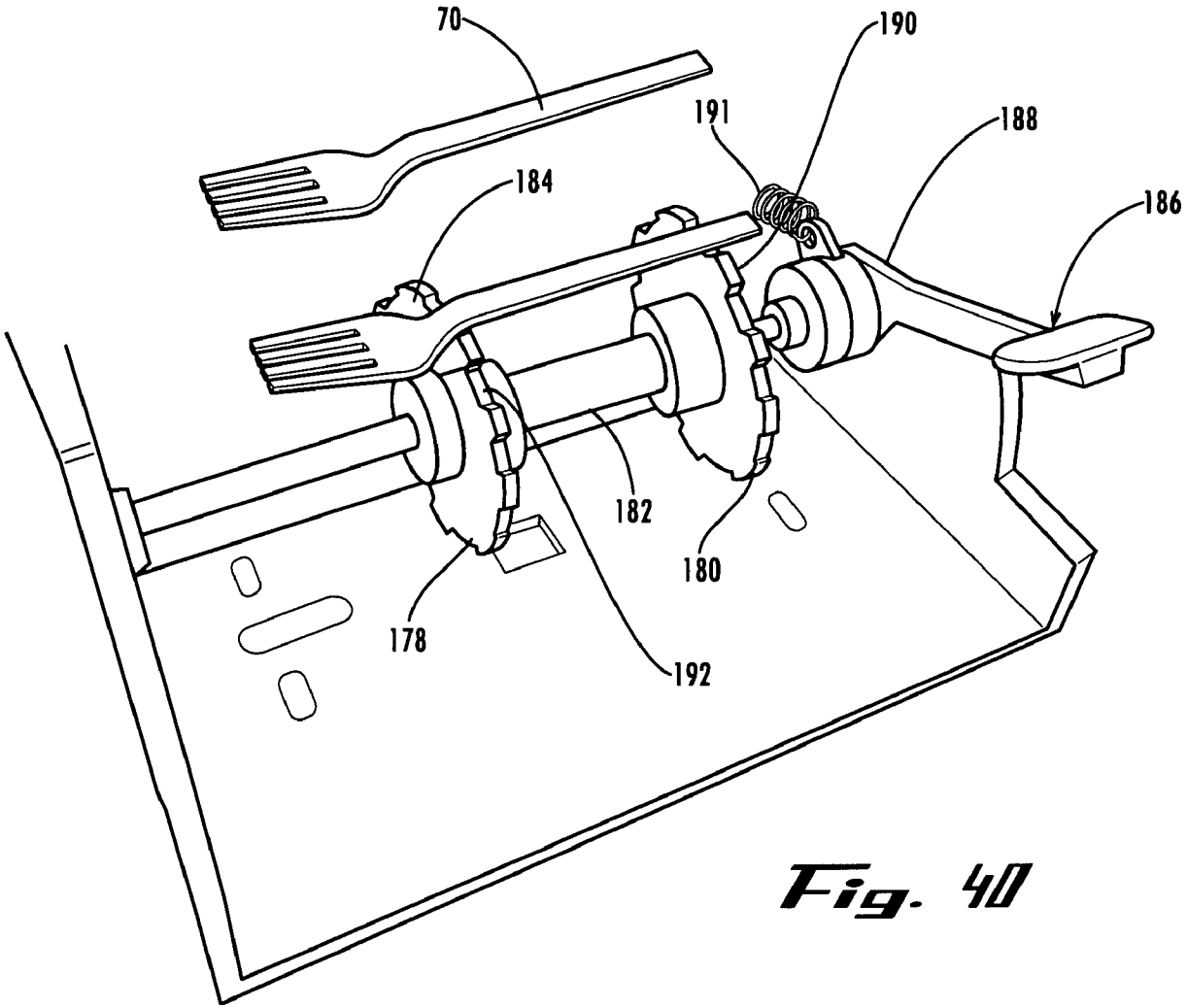
FIG. 40 is a cut away isometric view illustrating a rotatable cam and rotatable shaft configuration that uses a one way bearing at the handle.
Figure 41A:
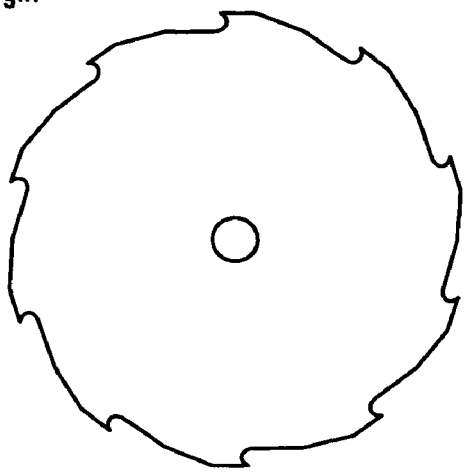
FIGS. 41*a*, 41*b*, 41*c* and 41*d* illustrate versions of the rotatable cams used in configurations for different types of cutlery.
Figure 41C:
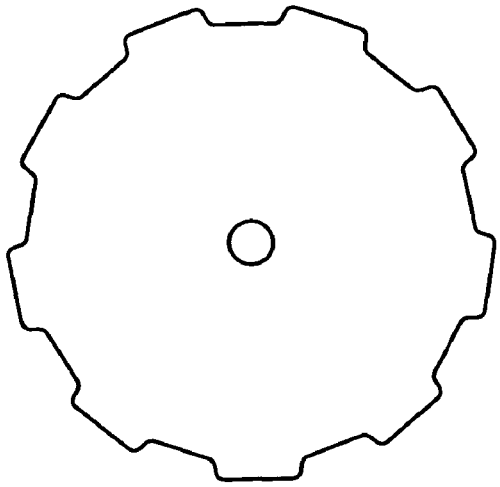
Figure 41B:
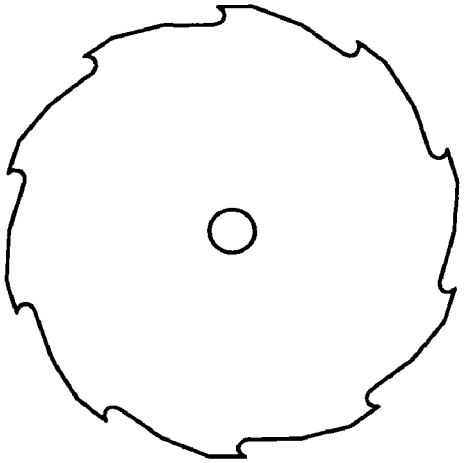
Figure 41D:
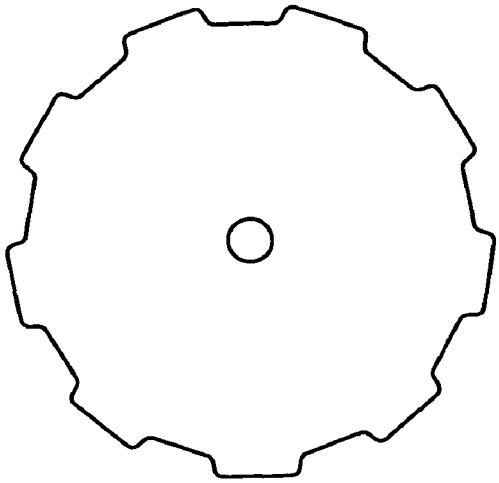

In FIG. 40, rotating cams 178 and 180 mounted upon rotatable shaft 182 having a one way bearing (not shown), such as part number HFZ040708B that is manufactured by INA (West Midlands, UK). This one way bearing (not shown) limits the direction of rotation to the clockwise direction only so that the top of the cam 192 rotates by spring 191 only toward the front of the dispenser (not shown) when actuating arm 188 with actuating handle 186 attached thereto is engaged. Spring 191 is attached to a housing (not shown). Spring 191 serves to limit forward movement of accuating arm 188. Rotating cam 178 has lateral displacement surface 192 and clearance shelf 180 formed therein. Rotating cams as illustrated in FIGS. 41*a* and 41*b* are suited for knives and spoons and rotating cams as illustrated in FIGS. 41*c* and 41*d* are suited for forks.

Figure 42:
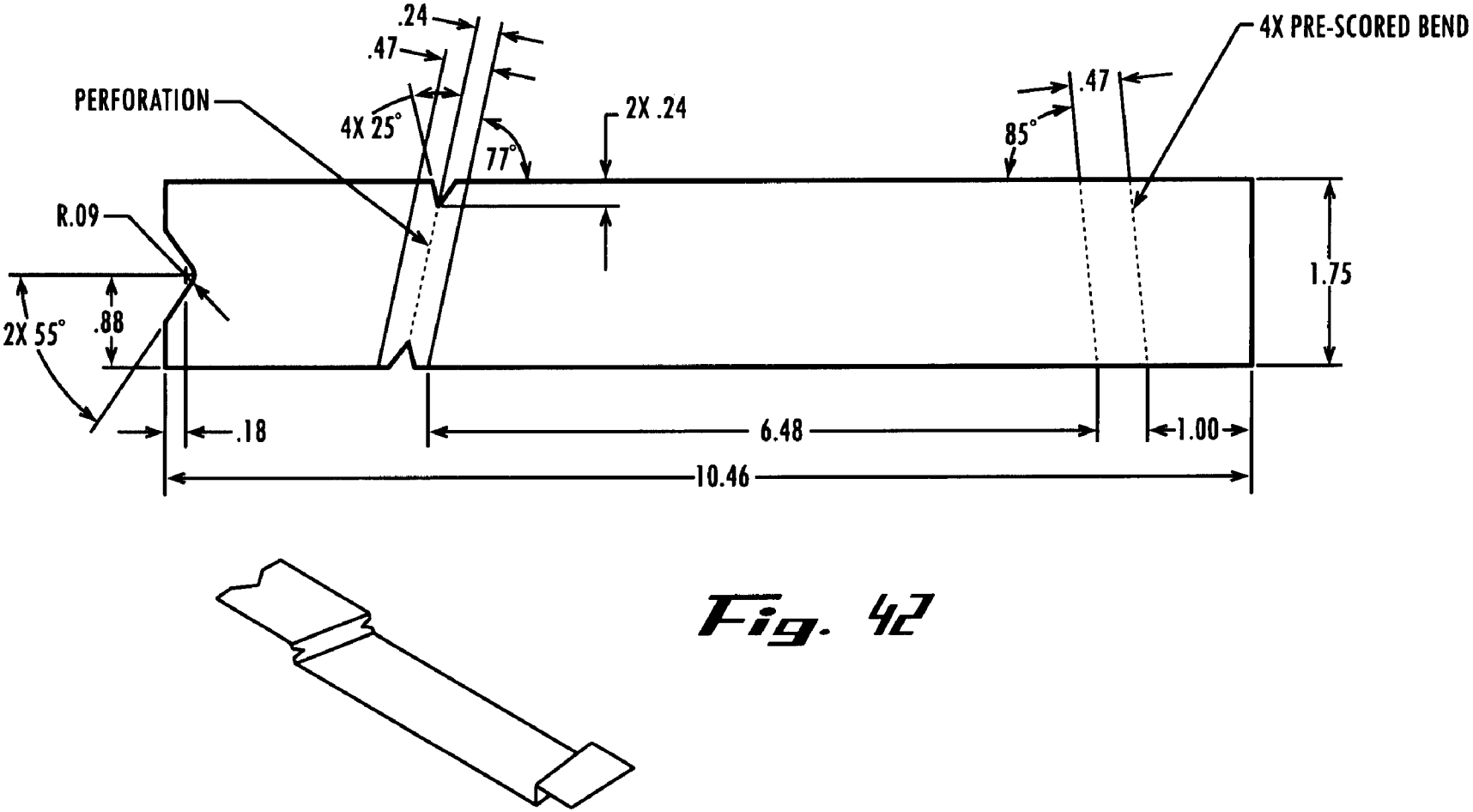
Figure 47:
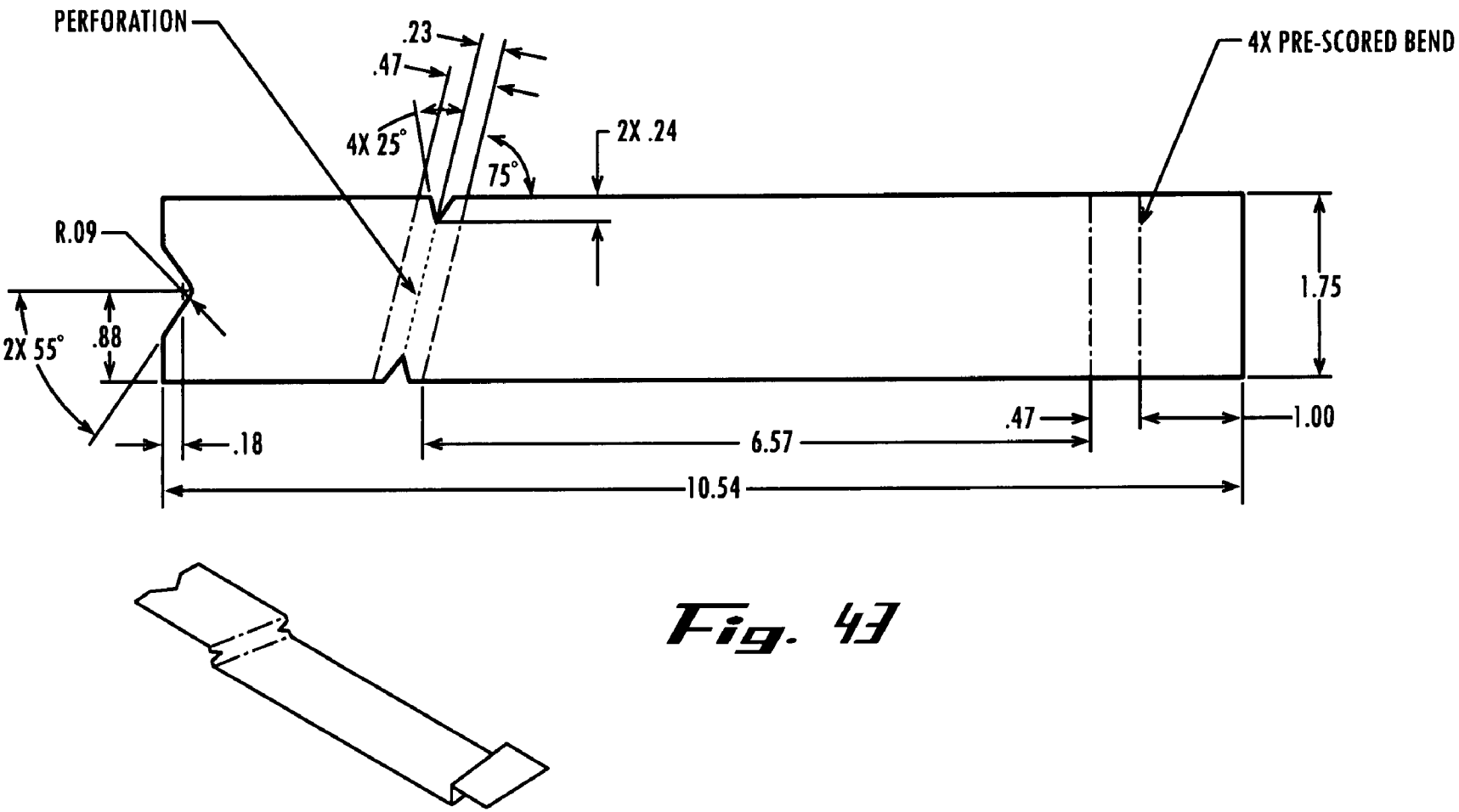
Figure 44:
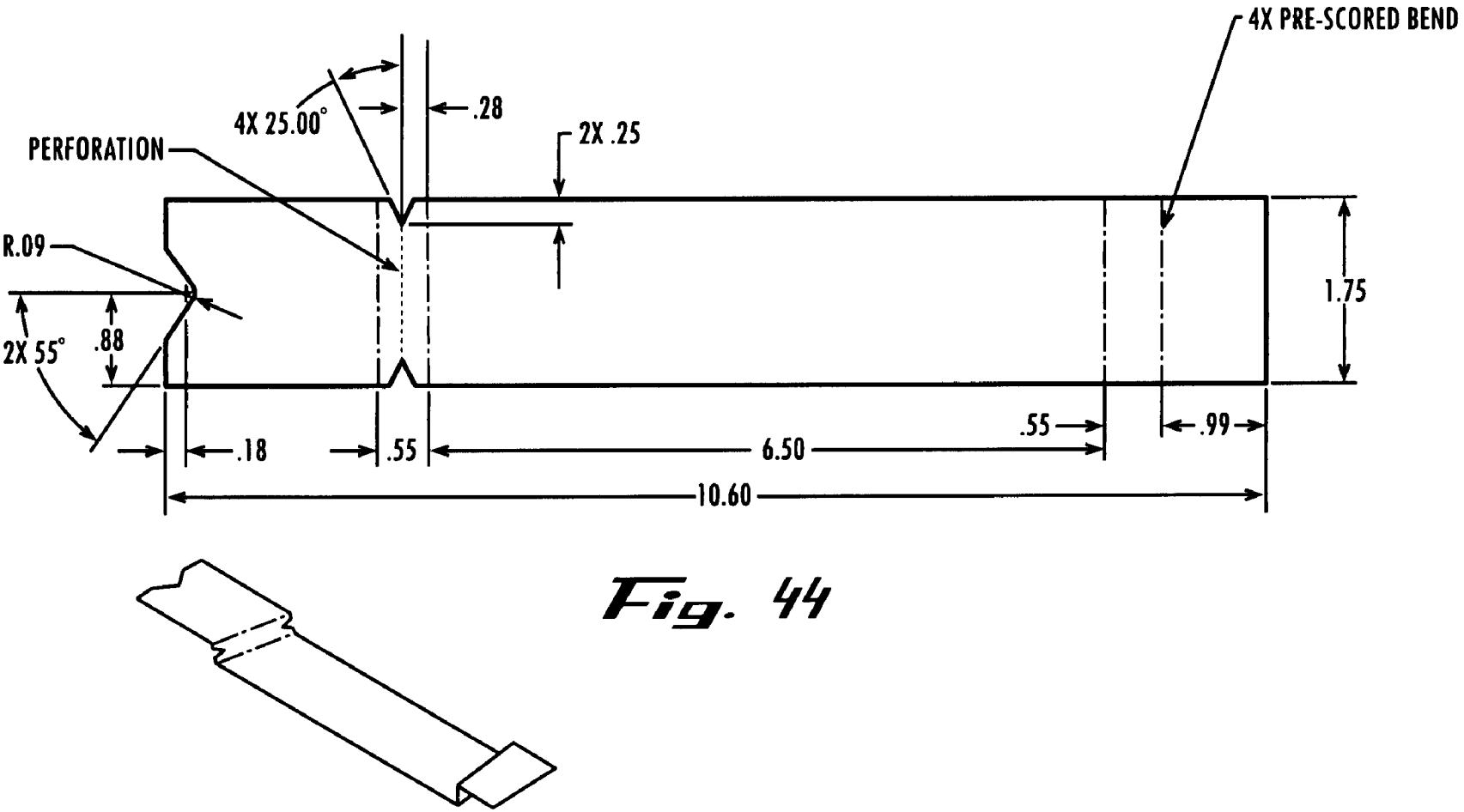

FIGS. 42, 43 and 44 show possible dimensions for a paperboard backer element for a spoon, fork and knife, respectively.

It will be apparent to those skilled in the art that various modifications and variations can be made in the present invention without departing from the scope of the invention. Other aspects of the invention will be apparent to those skilled in the art from consideration of the specification and practice of the invention disclosed herein. It is intended that the specification and examples be considered as exemplary only.

What is claimed is:

1. A banded stack of disposable cutlery comprising:

a plurality of disposable cutlery pieces disposed adjacent one another to provide a stack of the cutlery pieces;

at least one band disposed about the stack, wherein the band comprises a perforated portion;

wherein the band further comprises a first material and an adhesive; and wherein the band further comprises a first side and an opposite side, and wherein the first material is adjacent to the first side of the stack and the adhesive is adjacent to the opposite side of the stack, the adhesive portion at least partially adhered to the opposite side of the stack.

2. The banded stack of claim 1, wherein the first material comprises paperboard.

3. The banded stack of claim 2, wherein the adhesive is tape.

4. The banded stack of claim 1, wherein the band is removable without disturbing the stack.

5. The banded stack of claim 1, wherein the stack of the cutlery pieces comprises from about 30 to about 200 pieces of cutlery.

6. The banded stack of claim 1, wherein each piece comprises a stacking lug.

7. The banded stack of claim 1, wherein the stack of the cutlery pieces comprises at least 20 pieces of cutlery, and wherein the band is removable without disturbing the stack.

8. A banded stack of disposable cutlery, comprising:

a plurality of disposable cutlery pieces disposed adjacent one another to provide a stack of the cutlery pieces; and at least one band disposed about the stack, wherein the band comprises a tearable portion;

wherein the band further comprises a first material and an adhesive; and wherein the band further comprises a first side and an opposite side, and wherein the first material is adjacent to the first side of the stack and the adhesive is adjacent to the opposite side of the stack, the adhesive portion at least partially adhered to the opposite side of the stack.

9. The banded stack of claim 8, wherein the stack of the cutlery pieces comprises from about 30 to about 200 pieces of cutlery.

10. The banded stack of claim 8, wherein each piece comprises a stacking lug.

11. The banded stack of claim 8, wherein the first material comprises paperboard.

12. The banded stack of claim 8, wherein the adhesive is tape.

13. A banded stack of disposable cutlery, comprising:

a plurality of disposable cutlery pieces disposed adjacent one another to provide a stack of the cutlery pieces; and at least one band disposed about the stack, wherein the band comprises an adhesive portion and a non-adhesive portion;

wherein the stack of cutlery pieces comprises a first side and an opposite side, and wherein the non-adhesive portion is adjacent to the first side of the stack and the adhesive portion is adjacent to the opposite side of the stack, wherein the adhesive portion is at least partially adhered to the opposite side of the stack.

14. The banded stack of claim 13, wherein the adhesive portion comprises tape.

15. The banded stack of claim 13, wherein the non-adhesive portion comprises paperboard.

16. The banded stack of claim 13, wherein the paperboard comprises a perforated portion.

17. The banded stack of claim 13, wherein the cutlery is substantially residue free after the band is removed.

18. The banded stack of claim 13, wherein the peel strength of the adhesive portion is less than 1.6 lbs/in.

19. The banded stack of claim 13, wherein the adhesive portion of the band has a rolling ball tack of at least about 31 inches, as determined by PSTC-6.

20. The banded stack of claim 13, wherein the stack of the cutlery pieces comprises from about 30 to about 200 pieces of cutlery.

21. The banded stack of claim 13, wherein each piece comprises a stacking lug.

22. The banded stack of claim 13, wherein an adhesive is disposed on at least a portion of the band.

23. The banded stack of claim 1, wherein the perforated portion is at the top of the stack.

24. The banded stack of claim 1, wherein the perforated portion is disposed at or near a transition between the top of the stack and the first side of the stack.

* * * * *